US006439085B1

(12) United States Patent
Habermehl et al.

(10) Patent No.: US 6,439,085 B1
(45) Date of Patent: Aug. 27, 2002

(54) DOUBLE ARM PAWL FOR AUTOFEED SCREWDRIVER

(76) Inventors: G. Lyle Habermehl, 436 Calvert Dr., Gallatin, TN (US) 37066; Troy D. Hale, 105 Cline Ave., Hendersonville, TN (US) 37075; Paul Townsend Scherer, 4145 Bridgemont La., Lexington, KY (US) 40514

( * ) Notice: Subject to any disclaimer, the term of this patent is extended or adjusted under 35 U.S.C. 154(b) by 0 days.

(21) Appl. No.: 09/694,910

(22) Filed: Oct. 24, 2000

(51) Int. Cl.[7] ..... B25B 23/04

(52) U.S. Cl. ..... 81/434; 81/435

(58) Field of Search ..... 81/57.37, 431, 81/433, 434, 435

(56) References Cited

U.S. PATENT DOCUMENTS

| | | | | |
|---|---|---|---|---|
| 3,601,168 A | | 8/1971 | Ferstrom | |
| 3,826,419 A | | 7/1974 | Maestri | |
| 4,146,071 A | | 3/1979 | Mueller | |
| 5,542,323 A | | 8/1996 | Habermehl et al. | |
| 5,568,753 A | * | 10/1996 | Habermehl et al. | 81/434 |
| 5,570,618 A | | 11/1996 | Habermehl et al. | |
| 5,699,704 A | | 12/1997 | Habermehl | |
| 6,109,146 A | * | 8/2000 | Muro | 81/434 |
| 6,164,170 A | | 12/2000 | Habermehl et al. | |

* cited by examiner

*Primary Examiner*—D. S. Meislin
(74) *Attorney, Agent, or Firm*—Dorsey & Whitney LLP

(57) ABSTRACT

A blocking and/or advance pawl mechanism for an autofeed fastener driving tool with at least one of the pawl arms maintained rearward of a next fastener to be driven from a strip holding fasteners spaced in a row.

20 Claims, 14 Drawing Sheets

27
26
28
119
114
18
301
42
38
40
518
302
522
508
516
506
514
520
510
512
25
46
25
503
502
44
48
90
22
50
76
314
312
316
86
382
87
304
24
125
308
20
75

DOUBLE ARM PAWL FOR AUTOFEED SCREWDRIVER

SCOPE OF THE INVENTION

This invention relates to an improved screw advancing pawl for a strip advance and release mechanism of an apparatus which sequentially advances and drives fasteners retained in a holding strip.

BACKGROUND OF THE INVENTION

Autofeed screwdriver tools are known including U.S. Pat. No. 5,570,618 to Habermehl, issued Nov. 5, 1996 and U.S. Pat. No. 5,974,662 to Habermehl, issued Aug. 10, 1997 which have an advance mechanism utilizing a pawl with a single pawl arm to engage a screwstrip and advance the screwstrip.

The present inventor has appreciated that under some abnormal conditions, such as when the tool is not operated in a proper manner, disadvantages arise in that the known single pawl may not be moved into a position to engage any screws remaining in the strip and the strip may drop out of the tool.

SUMMARY OF THE INVENTION

The invention at least partially overcomes the disadvantages of the prior art by providing a blocking and/or advance pawl mechanism for an autofeed fastener driving tool with at least two pawl arms with at least one of the pawl arms maintained rearward of a next fastener to be driven from a strip holding fasteners spaced in a row. Preferably, the advance pawl mechanism provides for simultaneously manual deactivation of the at least two pawl arms to permit withdrawal of the screwstrip.

An object of the present invention is to provide an improved pawl for use in an autofeed screwdriving tool.

Another object is to provide a pawl for blocking withdrawal of a screwstrip from an autofeed fastener driving tool which has two spaced arms each of which are adapted to block withdrawal of a screwstrip.

Another object is to provide a pawl for advancing screwstrips in an autofeed fastening tool which has two spaced arms to engage two spaced screws in the screwstrip.

Accordingly, in one aspect, the present invention provides an apparatus for sequentially driving fasteners from a fastener strip comprising a plurality of fasteners secured in a row in a holding strip, the apparatus comprising:

a slide body having a lateral screwstrip receiving channelway and a guideway bore intersecting the channelway, the channelway configured to slidably receive the strip;

an elongate driver shaft having a shaft axis of rotation, said shaft including a fastener driving bit for engaging and driving fasteners in succession into a workpiece, said shaft being journalled and longitudinally slidably housed in said bore for reciprocal movement relative the slide body between an engaged position and a withdrawn position;

an advance mechanism mounted to said slide body for incrementally forwardly advancing the strip carrying the screws in the strip with the axis of each screw to pass in succession along a plane of advance within the channelway into the bore, said advance mechanism including a linkage member housed in said slide body and reciprocally movable between an advanced position and a retracted position as a function of cyclical reciprocal relative movement of the slide body and driver shaft, a pawl pivotally mounted on the linkage member for pivoting between a first blocking position and a second passage position, the pawl having a first arm with a first screw engaging surface and a second arm with a second screw engaging surface, in the first blocking position, both the first and second engagement surfaces are positioned in the plane of advance such that the first engagement surface blocks any screw in the screwstrip immediately forward of the first engagement surface from movement relative the first engagement surface rearwardly pass the first engagement surface and the second engagement surface blocks any screw in the screwstrip immediately forward of the second engagement surface for movement relative the second engagement surface rearwardly past the second engagement surface, in the second passage position, both the first and second engagement surfaces are positioned out of the plane of advance such that they do not block screws in the screwstrip forward of the first or second engagement surfaces from movement relative the first and second engagement surfaces rearwardly past the first or second engagement surfaces.

Further aspects of the invention will become apparent upon review of the following detailed description.

BRIEF DESCRIPTION OF THE DRAWINGS

Further aspects and advantages of this invention will become apparent from the following description taken together with the accompanying drawings in which.

DETAILED DESCRIPTION OF THE DRAWINGS

Toeing Nosepiece

Figure 1:
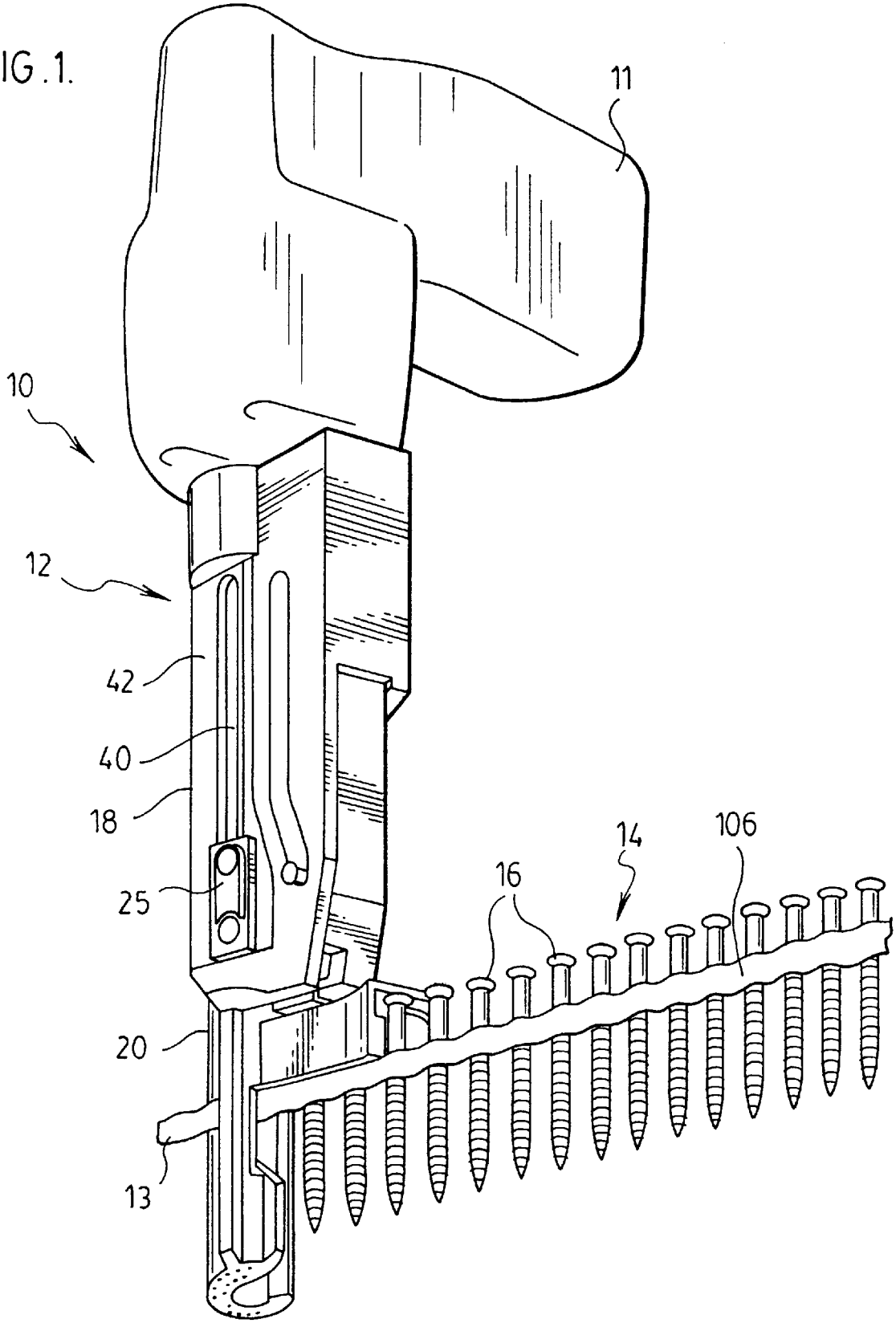
FIG. 1 is a pictorial view of a power screwdriver in accordance with a first preferred embodiment of the present invention.

Reference is made first to FIG. 1 which shows an autofeed screwdriver attachment of the type disclosed in U.S. Pat. No. 5,934,162, issued Aug. 10, 1999, the disclosure of which is incorporated herein by reference.

The operation of the device shown in FIGS. 1 to 5 is known and, therefore, its operation will now only be briefly disclosed with reference to FIGS. 1 to 5. The major components of the mechanism comprise a housing 18 and a slide body 20. The housing 18 is adapted to be secured to a driver housing 30 (only shown in FIG. 4) of a power driver 11 with a chuck 32 of the power driver engaging a driver shaft 34 for rotation of the driver shaft about an axis 52. The slide body 20 is received within the housing 18 for relative sliding parallel the axis 52. The slide body 20 has a nose portion 24 with a guideway 82 extending axially therethrough coaxially about the driver shaft 34. A screw feed channel element 76 provides a channelway 88 which extends radially relative the longitudinal axis 52 to intersect with the guideway 82 and provide a mechanism for screws 16 held in a plastic strip 13 to be successively fed into the guideway 82 into axial alignment with the driver shaft for driving forwardly from the guideway 82 by the bit 122 carried on the forward end of the driver shaft 34. An exit opening 87 is provided in the guide tube 74 to permit spent plastic strip 13 from which screws 16 have been driven to exit from the guideway 82. An advance mechanism is provided to successively advance screws into the guideway 82 with each subsequent cycle of retraction of the slide body 20 into the housing 18 so as to drive a screw, and extension of the slide body 20 out of the housing 18 to withdraw the driver shaft 34 rearwardly and advance a new screw into the guideway 82.

In one aspect, the present invention is directed to the configuration of the forward end of the nose portion 24 for advantageous engagement with a workpiece.

Figure 6:
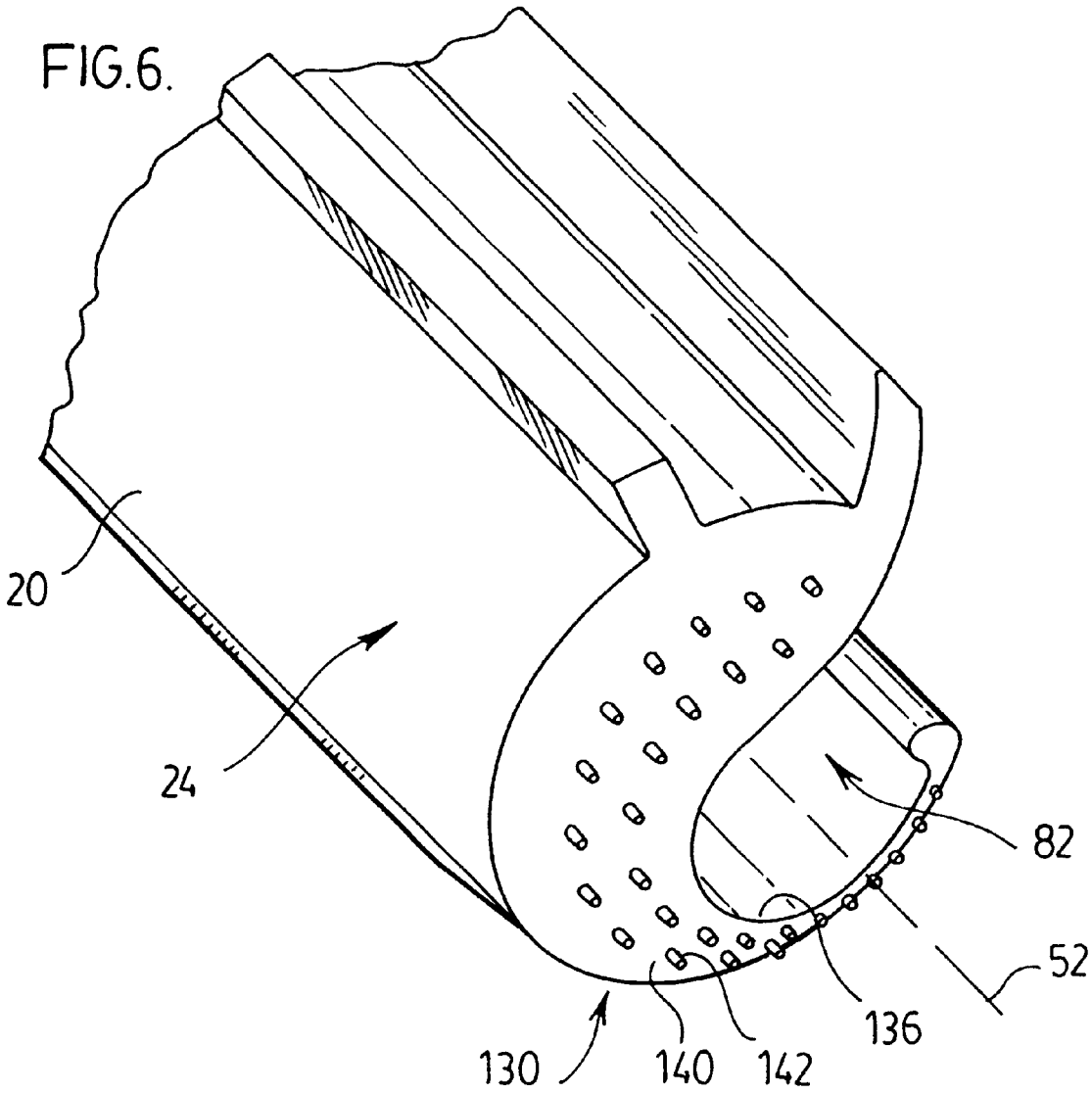
FIG. 6 is a partial pictorial view of the forward end of the slide body shown in FIG. 3.
Figure 7:
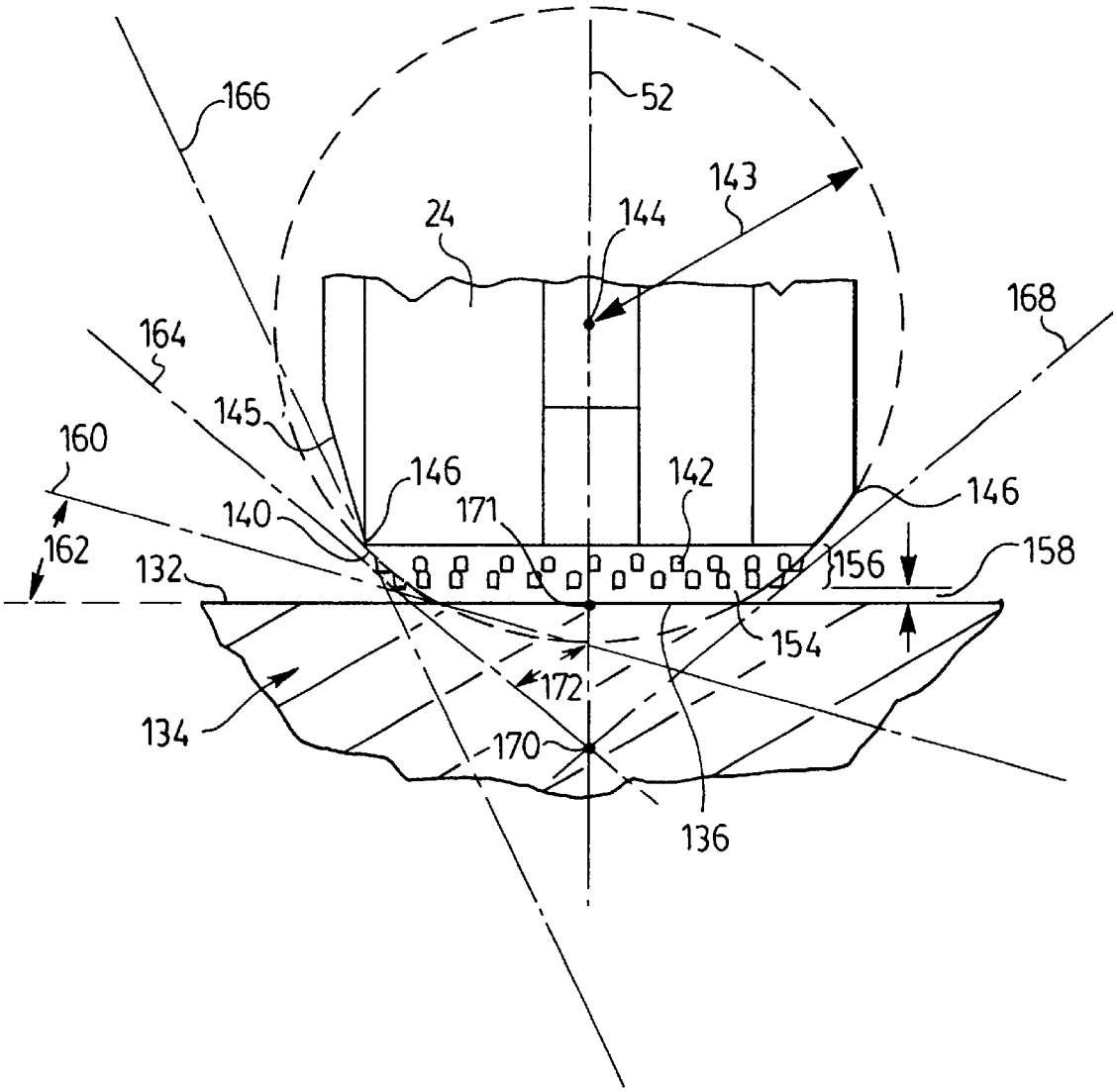
FIG. 7 is a schematic side view showing a forward end of the slide body of FIG. 6 driving a screw into a workpiece, with the screw normal to the outer surface of the workpiece.

As may be best seen in FIGS. 6 and 7, the nose portion of the slide body 20 has a forward contact surface generally indicated 130 adapted to engage the outer surface 132 of a workpiece 134. The nose portion is shown in FIG. 6 with the guideway 82 opening forwardly through the contact surface 130 as a fastener exit opening 136. The contact surface 130 is shown to extend from the fastener exit opening 136 radially outwardly relative the axis 52 and rearwardly.

The contact surface 130 is shown as comprising a smooth, part spherical surface 140 and a plurality of protrusions 142. As best seen in FIG. 7, the part spherical surface 140 is effectively shown as a portion of a sphere of a radius 143 centered on point 144 on axis 52. The center of the sphere is located relative to the fastener exit opening 136 such that from the fastener exit opening 136, the surface 140 extends radially to the side and rearwardly but not forwardly. The part spherical surface 140 is shown extending radially from the exit opening 136 to a rearward edge 146 rearward of which the surfaces of the nose portion are shown to extend rearwardly at least at an angle of about 75° from the axis 52 as indicated by surface 145 on the left-hand side of FIG. 7. Preferably, the radius 143 of the sphere is as small as possible so that when driving a screw with the axis 52 tilted only a minimal additional distance is required for driving the screw into a fully countersink position compared to that when the axis 52 is normal the surface of the workpiece. Preferably, the radius 143 of the sphere is not greater than three times, more preferably, two times or one times the diameter of the guideway 82. Preferably, the radius 143 is about equal to the diameter of the guideway 82 although the radius 143 may be less than the diameter of the guideway 82.

A plurality of protrusions 142 are shown provided in an array on the surface 140. Each of the protrusions is shown as a spike-like member which extends at least partially forwardly from a base at the surface 140 to a distal end. Preferably, as shown, the protrusions extend from the surface 140 parallel to axis 52 about the base. Alternatively, the protrusions may extend normal to the surface 140. Each of the distal ends of the protrusions are preferably adapted to provide for increased frictional engagement with a work surface as is advantageous to prevent slippage.

Figure 5:
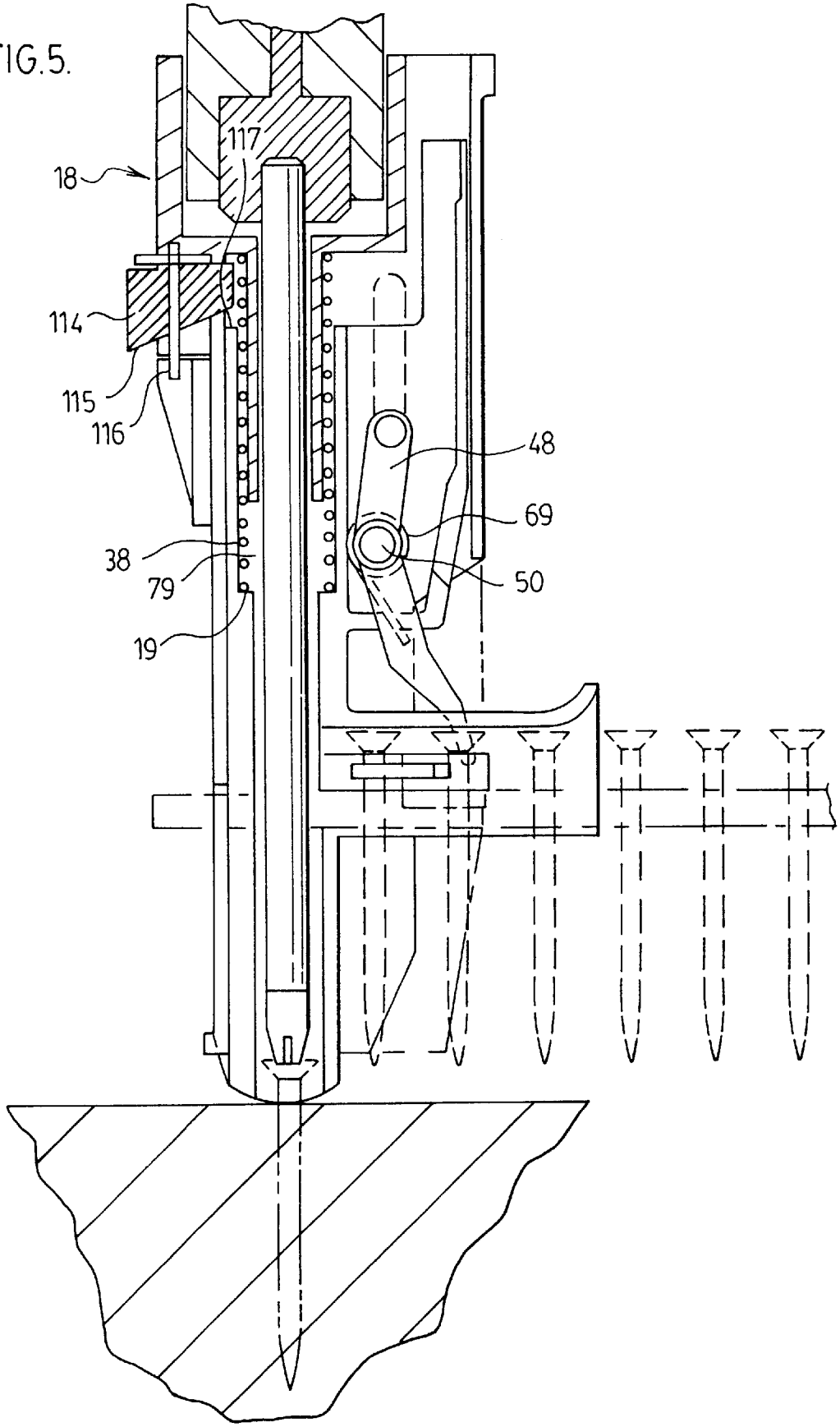
FIG. 5 is a view identical to FIG. 4 but with the drive attachment in a partially retracted position in driving a screw into a workpiece.

FIGS. 5, 6 and 7 show the fastener exit opening 136 lying in a plane normal the axis 52 such that the surface 140 immediately adjacent the fastener exit opening 136 comprises the forwardmost portion of the surface 140.

As shown in FIGS. 6 and 7, the contact surface 140 includes a radially innermost zone 154 adjacent the fastener exit opening 136 which innermost zone 154 is adapted to engage a flat surface of a workpiece when the nose portion 24 is urged into a workpiece with the axis 52 substantially normal to the flat surface of the workpiece. As seen in FIG. 6, radially outward of the innermost zone 154, an outer zone 156 is indicated. The protrusions 142 are provided on this outer zone 156 of the contact surface radially outwardly from the innermost zone 154 and rearward of the innermost zone 154. As shown in FIG. 7, the forward distal ends of the protrusions 142 have a forward extent which is rearward of the innermost zone 154. In FIG. 7, the flat surface 132 of the workpiece 134 represents a plane in which the exit opening 136 lies with the axis 52 normal to the flat surface 132 of the workpiece. As seen in FIG. 7, the forwardmost extent, i.e. the distal ends, each of the protrusions 142 are spaced rearwardly from flat surface 132 by a distance indicated as 158 and, thus, the protrusions 142 are located such that they do not engage a flat surface of a workpiece when the axis 52 is normal the flat surface of the workpiece. The protrusions 142 are preferably provided with the forwardmost distal ends of the protrusions 142 terminating at a forwardmost extent rearward, relative the axis 52, of the innermost zone 154.

Referring to FIG. 7, a dashed line 160 is shown as a line at an angle 162 to the axis 52 and which line 160 represents a plane in which a flat surface of a workpiece would need to be disposed so as to engage both the innermost zone 154 and the distal end of a radially innermost protrusion 142. It is to be appreciated that any flat surface disposed at an angle to the axis 52 in between the line 160 and surface 132 would merely engage the surface 140 over the innermost zone 154 with the protrusions 142 spaced rearwardly therefrom. The angle 162 between the line 160 and surface 132 is preferably in the range of about 2° to 10° and, more preferably, about 5°. In this application, an angle referred to as being "substantially normal the axis" is to be interpreted as meaning an angle of not greater than 10° to a normal. The innermost zone 154 is preferably defined as being that portion of the surface 140 radially about the fastener exit opening 136 which engages a flat surface of a workpiece when the axis 52 is substantially normal the flat surface, i.e. when the axis 52 is at an angle of less than 10°, more preferably, less than 5° from a normal.

Thus, as seen in FIG. 7, the protrusions 142 do not engage a flat surface of a workpiece when the axis 52 is substantially normal the flat surface of the workpiece as, for example, when the axis 52 is disposed at an angle of 10° or 5° or less to a normal to the flat surface. The protrusions 142 are adapted to engage a flat surface of a workpiece only when the axis 52 is disposed at an angle equal to or greater than angle 162, preferably, at an angle greater than about 10° or 5° to a normal to the flat surface.

As seen in FIG. 6, the protrusions 142 are shown as arranged in two concentric rings with radially inner protrusions in the inner ring and radially outer protrusions in the outer ring. In FIG. 7, a dashed line 164 represents the surface of a flat workpiece disposed to engage the distal ends of both a radially inner protrusion 142 and a radially outer protrusion 142. As seen, line 164 does not engage the innermost zone 154. A further line 166 represents the surface of a flat workpiece disposed to engage a radially outer protrusion 142 and the rearward edge 146 of the part spherical surface 140.

It is to be appreciated that, as seen in FIG. 7, a nose portion 24 may be engaged on a work surface with the axis perpendicular to the work surface and then angled to one side to successively adopt configurations in which the relative position of the workpiece flat surface 132 is indicated by lines 132, 160, 164 and 166 in succession. In accordance with a preferred aspect of the invention, the line 160 is disposed at an angle of about 70° to 80° to the axis 52, line 164 is disposed at an angle of about 50° to 60° to the axis 52 and the line 166 is disposed at an angle of about 20° to 30° to the axis 52.

FIG. 7 illustrates the condition in which the nose portion of the slide body in accordance with the present invention is utilized to drive a screw into a surface of a workpiece 134 with the axis 52 normal to the upper surface 132 of the workpiece. In the condition shown in FIG. 7, the protrusions 142 do not engage the flat upper surface 132 of the workpiece 134, rather, engagement is accomplished merely over the innermost zone 154 of the surface 140.

Referring to FIG. 7, line 168 is provided corresponding to line 164, however, representing a condition where, in effect, the axis 52 is tilted an equal amount in an opposite direction. The two lines 168 and 164 intersect at the axis 52 at a point 170. It is to be appreciated that the contact surface 130 is provided rearwardly from each of these lines 164 and 168, with the lines, when rotated about the axis, effectively defining a cone at an angle of angle 172 from the axis and with the point 170 located a set distance from the point 171 on the axis lying in the plane of the fastener exit opening 136. Preferably, the contact surface 130 lies rearward of the surface of the cone extending rearwardly at an angle of, at most, 45° from the axis 52 and centered on the axis 52 at a point such as 170 forward of the point 171 on the axis where the plane of the fastener exit opening intersects the axis by a distance of at least one half the diameter of the guideway 82.

Figure 8:
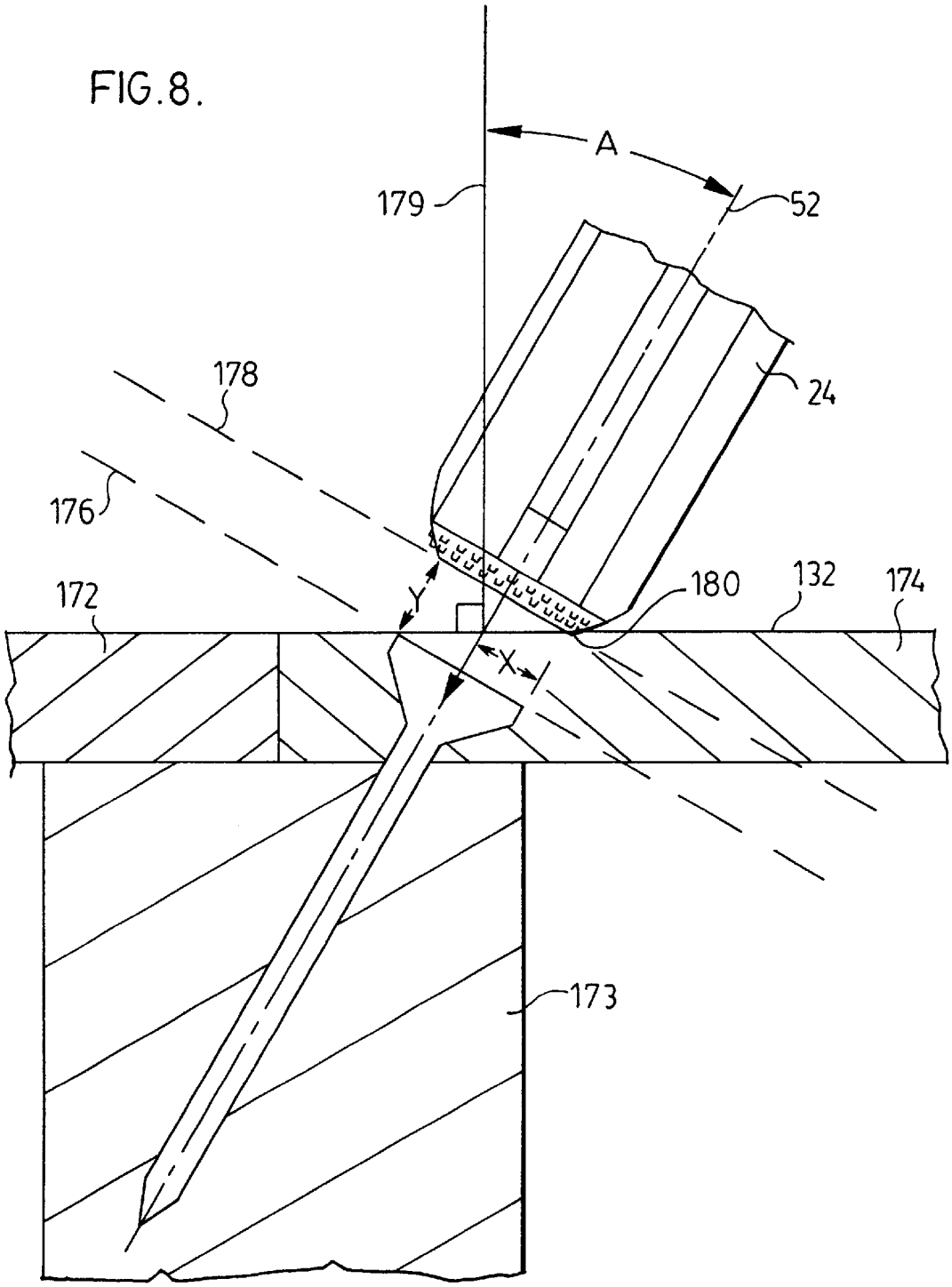
FIG. 8 is a schematic side view substantially the same as that shown in FIG. 7, however, showing the screw being driven into the workpiece at an angle to the vertical.

A preferred tool in accordance with the present invention is particularly adapted for driving screws at an angle into a workpiece. Driving screws at an angle into a workpiece is referred to as "toeing" a screw into a workpiece. Driving screws at an angle is particularly preferred where screws are used to secure plywood floors to floor joists. FIG. 8 schematically shows two one-half inch thick pieces of wood flooring plywood 172 and 174 in abutting relationship overlying a conventional wood floor stringer 173 of nominal two-inch thickness which has an actual thickness of about 1 ⅝ inches. As it is preferred that the screw being driven to secure the edge of each piece of plywood 174 into the stringer 173 be spaced about a half inch from the edge of the plywood, it is preferred, therefore, that the screw be driven at an angle to the flat upper surface of the plywood down into the stringer. Preferred angles for driving screws, such as shown in FIG. 8, are in the range of 60° to 85° and, more preferably, about 65° to 80° and, even more preferably, about 75°. FIG. 8 shows an arrangement with the axis 52 disposed at an angle of 65° to a normal to the upper surface 132 of the plywood 174. Under the conditions shown in FIG. 8, the protrusions 142 engage the upper surface 132 of the plywood and assist in preventing the nose portion 24 from slipping on the upper surface 132.

The present invention has been described with reference to a nosepiece for an autofeed screwdriver. It is to be appreciated that a similar nose could be provided with tools of various types to drive fasteners including devices to drive a wide variety of different fasteners including screws and other threaded fasteners and nails, tacks, studs, posts and the like.

The protrusions 142 are shown in FIG. 6 as comprising an array of protrusions comprising a first radially inner row of protrusions disposed in a circular arc about the axis 52 and a second radially outward row of protrusions disposed in a second arc about the axis 52 radially outwardly from the first arc. About seventeen protrusions are shown in the inner row and more in the outer row. With the protrusions 142 preferably being of similar length as shown, it follows that the distal ends of the protrusions lie on a spherical surface formed by rotating a radius on centerpoint 144 with the radius being greater than the radius 143 by the length of the protrusions. The length of the protrusions 142 is small relative to the radius 143 of the sphere of the contact surface 140, preferably in the range of less than about 1/10 or 1/15 or 1/20 of the radius 143. Protrusions 142 are preferred to be provided of a spike-like configuration to frictionally engage the surface of a workpiece, however, various other friction enhancing surfaces and surface treatments may be provided in substitution for the protrusions 142 and their spike-like distal ends.

The preferred embodiment shows the innermost zone 154 of the surface 130 as being smooth as is preferred so as to avoid marking or marring the surface of a workpiece when a screw is being driven into a workpiece with the axis 52 substantially normal the surface of the workpiece. It is appreciated that the innermost zone 154 need not be smooth but, rather, may merely be provided with any other configuration which reduces the likelihood of marking or marring a surface of the workpiece. The surface of the innermost zone 154 is to be contrasted with the contact surfaces over the outer zone 156 which is to provide for frictional engagement as characterized in the preferred embodiment by the spike-like distal ends of the protrusions 142.

The preferred embodiment shows the contact surface 130 which tapers inwardly and rearwardly almost entirely surrounds about the fastener exit opening 136. It is to be appreciated that the nose portion may merely have its contact surface tapered inwardly on one or both sides of the fastener exit opening 130.

A screw is fully countersunk when no portion of the screw 16 is above the surface 132. When driving a screw into a workpiece with the axis 52 normal the flat surface of the workpiece as seen in FIG. 7, full countersinking arises by driving the screw so that no portion of the screw is above the flat surface 132 which coincides with a plane in which the fastener exit opening 136 lies.

In accordance with an aspect of the present invention, it is advantageous that on tilting of the nose portion to drive a screw at an angle, that the radially innermost point of contact of the contact surface 130 with the workpiece be as close to the axis 52 as possible. This aspect is illustrated with reference to FIG. 8. FIG. 8 schematically shows a screw 16 which has been countersunk into the workpiece when the screw is driven into the workpiece with the axis 52 at an angle to the flat surface 132 of the workpiece. As seen in FIG. 8, point 180 is a point about which the contact surface 130 tilts. This point 180 is shown as the radially innermost point of contact of the contact surface 130 with the flat surface 132 of the workpiece. In tilting of the nosepiece 24 relative the surface 132, point 180 is a fulcrum about which tilting occurs. In FIG. 8, line 176 represents a plane in which the head of the screw 16 lies when the screw 16 has been fully countersunk. Line 178 represents a plane in which the fastener exit opening 136 lies and, therefore, also represents a plane in which the head of the screw 16 would lie if the screw 16 had been driven normal a surface 132 of the workpiece and fully countersunk. The distance Y between the two parallel lines 176 and 178 represents the increased distance the screw had to be driven to fully countersink when the screw is driven at an angle to the normal as contrasted with when the screw is driven normal the workpiece. The distance from the axis 52 to a point 180 about which the nosepiece pivots for tilting is shown as X. The distance Y can be calculated as follows:

$$Y=2X \text{ tangent (angle } A)$$

where A is the angle of the axis 52 to a line 179 normal to the surface 132. For any given angle A, therefore, the location of the tilt or fulcrum point 180 from the axis 52 increases the distance Y which the screw must be driven to be fully countersunk.

An autofeed screwdriver as illustrated in FIGS. 1 to 5 may be provided with a depth adjustment mechanism which restricts the depth to which the driver shaft 34 drives a screw into a workpiece. It is advantageous if the screwdriver may be provided to have minimal required adjustment of countersinking. To have the innermost contact and fulcrum point 180 at which the contact surface 130 of a nosepiece engages the workpiece located as close as possible to the axis 52 is advantageous.

In a situation where the diameter of the guide tube is represented by a given diameter, which diameter is preferably only marginally greater than the diameter of a screw to be driven, the present inventor has appreciated that preferred nose portions 24 in accordance with the present invention provide for the innermost contact point 180 of the contact surface 130 to be within a radius of not greater than three times or two times the diameter of the guideway. Preferably, when the axis 52 is tilted at an angle to a normal to the surface 132 of up to about 60°, the innermost point of contact 180 is located a distance from the axis 52 not greater than a distance equal to twice the radius of the guideway and, preferably, not greater than a distance equal to 1.5 times the radius of the guideway, more preferably, not greater than a distance equal to 1.25 times the radius of the guideway.

Driver Attachment

Reference is again made to FIG. 1 which shows a complete power screwdriver assembly 10 in accordance with the present invention. The assembly 10 comprises the power driver 11 to which a driver attachment 12 is secured. The driver attachment 12 receives a collated screwstrip 14 comprising a plastic strip 13 and spaced screws 16 held by the strip 13 to be successively driven.

Figure 3:
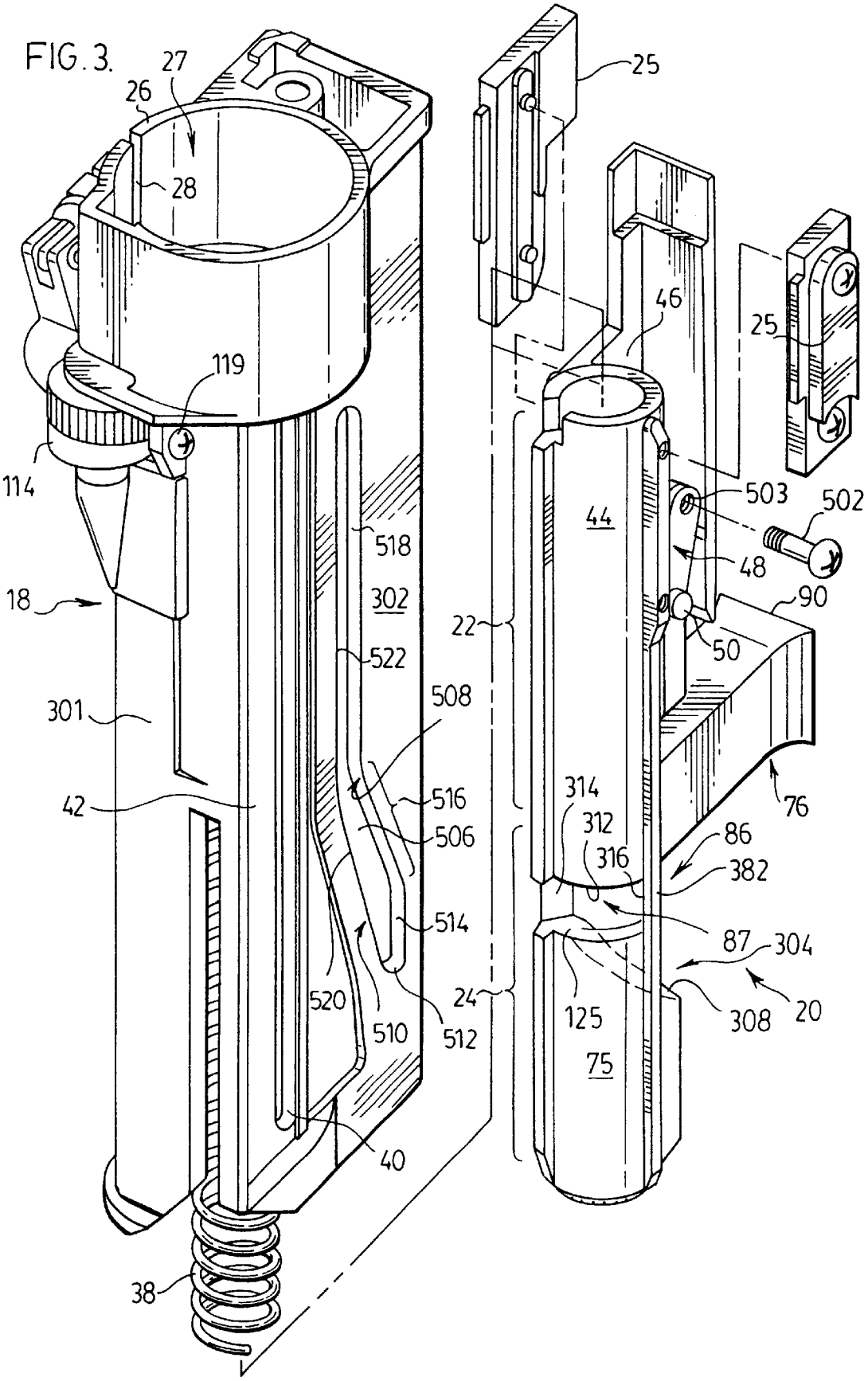
FIG. 3 is an exploded pictorial view of the driver attachment shown in FIG. 1.
Figure 4:
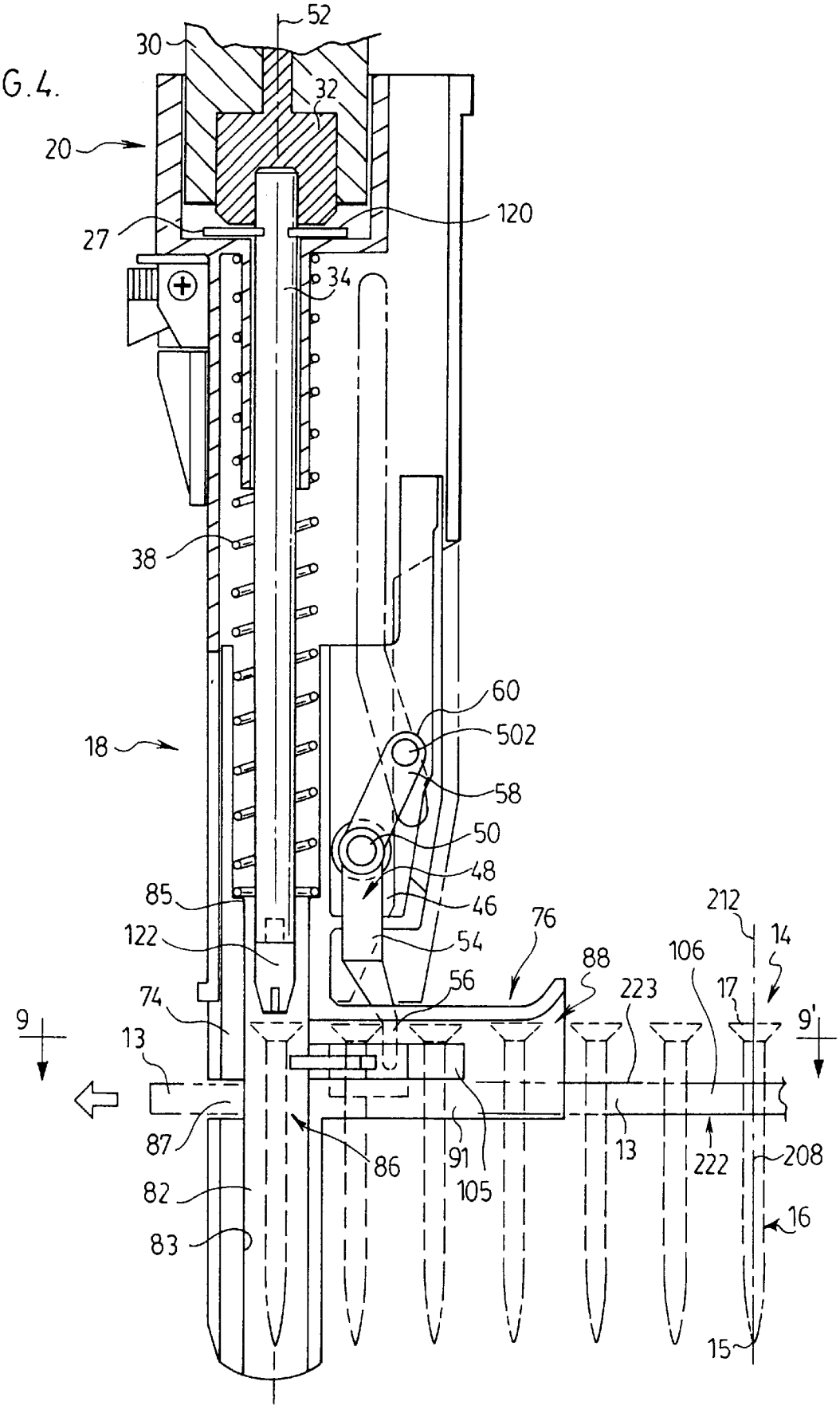
FIG. 4 is a schematic partially cross-sectional view of the driver attachment of FIG. 1 in a fully extended position as seen in FIG. 1 through a plane passing through the longitudinal axis of the drive shaft and centrally of the screws in the screwstrip.

Reference is made to FIG. 3 showing an exploded view of major components of the driver attachment 12 as housing 18 and a slide body 20 comprising a rear portion 22 and a nose portion 24. FIGS. 4 and 5 show in cross-section the interaction of these components.

As seen in FIG. 3, the rearmost end 26 of the housing 18 has a rearwardly directed socket 27 with a longitudinal slot 28 in its side wall to receive and securely clamp the housing 18 onto the driver housing 30 of the power driver 11 so as to secure the housing 18 of the driver attachment to the housing 30 of the power driver against relative movement. The power driver 11 has a chuck 32 rotatable in the driver housing 30 by an electric motor (not shown). The chuck 32 releasably engages the driver shaft 34 in known manner.

As seen in FIG. 4, the slide body 20 is slidably received in the housing 18 with the driver shaft 34 received in a bore passing through the slide body 20. A compression spring 38 disposed between the housing 18 and the slide body 20 coaxially about the driver shaft 34 biases the slide body away from the housing 18 from a retracted position towards an extended position. As shown, the spring 38 is disposed between the housing 18 and the slide body 20. Slide stops 25, best shown in FIG. 3, are secured to a rear portion 22 of the slide body. Two slide stops 25 slide in two longitudinal slots 40 on each side of the side wall 42 of the housing 18 to key the slide body to the housing 18 against relative rotation and to prevent the slide body being moved out of the housing 18 past a fully extended position.

The rear portion 22 comprises a generally cylindrical element 44 with a radially extending flange element 46 on one side. A lever 48 is pivotally mounted to the flange element 46 by axle 50 for pivoting about an axis of axle 50 normal to the longitudinal axis 52 which passes centrally through the drive shaft 34 and about which the drive shaft is rotatable. Lever 48 has a forward arm 54 extending forwardly to its front end 56 and a rear arm 58 extending rearwardly to its rear end 60.

The rear arm 58 of the lever 48 carries a cam pin 502 near its rear end 60. The cam pin 502 is a removable cylindrical pin threadably received in threaded opening 503 in rear arm 58. A cam slot 506 is provided in the side wall 302 of the housing 18.

The cam slot 506 has a first camming surface 508 and a second camming surface 510 spaced therefrom and presenting different profiles as best seen in side view in FIG. 3. The cam pin 502 is received in cam slot 506 between the first and second camming surfaces 508 and 510 for engagement of each under different conditions of operation. Spring 69 about axle 50, as shown in FIG. 5, biases the lever 48 in a clockwise direction as seen in FIG. 5 and thus biases the lever to pivot in a direction which moves a shuttle 96 shown in FIG. 2 towards the axis 52 of the guide tube and biases the cam pin 502 towards the first camming surface 508.

In operation of the driver attachment, the slide body 20 moves relative the housing 18 in a cycle of operation in which the slide body moves in a retracting stroke from the extended position to the retracted position and then moves in an extending stroke from the retracted position to the extended position. Whether in any position in a cycle the cam pin 502 will engage either the first camming surface 508 or the second camming surface 510 will depend on a number of factors. Most significant of these factors involve the resistance to movement of the shuttle 96 in either direction as compared to the strength of the spring 69 tending to move the shuttle 96 towards axis 52. Under conditions in which the bias of the spring 69 is dominant over resistance to movement of the shuttle 96, then the bias of the spring will place the cam pin 502 into engagement with the first camming surface 508 with relative motion of the lever 48 and therefore the shuttle 96 relative the position of the slide body 20 in the housing 18 to be dictated by the profile of the first camming surface 508. Under conditions where the resistance to movement of the shuttle is greater than the force of the spring 69, then the cam pin 502 will either engage the first camming surface 508 or the second camming surface 510 depending on the direction of such resistance and whether the slide body is in the retracting stroke or the extending stroke. For example, in an extending stroke when the shuttle 96 is engaging and advancing the next screw to be driven and the resistance offered to advance by the screwstrip may be greater than the force of the spring 69, then the cam pin 502 will engage on the second camming surface 510.

In the preferred embodiment shown, as best seen in FIG. 3, the first camming surface 508 has a first portion 514, a second portion 516 and a third portion 518. The first portion 514 and the second portion 518 are substantially parallel the driver shaft axis 52. Second portion 516 extends at an angle rearwardly and towards axis 52.

The second camming surface 510 has a first portion 520 which extends angling forwardly and away from axis 52 and a second portion 522 which is substantially parallel the axis 52.

The third portion 518 of the first camming surface 508 and the second portion 522 of the second camming surface 510 are parallel and disposed a distance apart only marginally greater than the diameter of cam pin 502 so as to locate the cam pin 506 therein in substantially the same position whether the cam pin 502 rides on first camming surface 508 or second camming surface 510.

The cam slot 506 has a front end 512 where the first portion 514 of the first camming surface 508 merges with the first portion 520 of the second camming surface 510. In the front end 512, the width of the cam slot 506 is also only marginally greater than the diameter of the cam pin 502 so as to locate the cam pin 506 therein in substantially the same position whether the cam pin 502 rides on the first camming surface 508 or the second camming surface 510.

The first portion 520 of the second camming surface 510 is spaced from the first camming surface 508 and, in particular, its first portion 514 and second portion 516 by a distance substantially greater than the diameter of cam pin 502.

A more detailed description of the interaction of the cam pin 502 in the cam slot 508 is found in U.S. Pat. No. 5,934,162 to Habermehl.

The nose portion 24 of the housing 20 has a generally cylindrical screw guide element or guide tube 75 arranged generally coaxially about longitudinal axis 52 and a flange-like screw feed channel element 76 extending radially from the guide tube 75.

The guide tube 75 has a cylindrical bore or guideway 82 extending axially through the guide tube with the guideway 82 delineated and bordered by a radially extending cylindrical side wall 83 and open at its forward axial end and at its rearward axial end 85.

The guide tube 75 has a rearward section adjacent its rear end 85 in which the side wall 83 extends 360° about the guideway 82. Forward of the rearward section, the guide tube has a forward section which has an access opening 86, shown in FIGS. 4 and 5 as being on the right hand side of the guide tube 75. Screw access opening 86 is provided to permit the screwstrip 14 including retaining strip 13 and screws 16 to move radially inwardly into the guideway 82 from the right as seen in FIGS. 4 and 5. Each screw preferably has a head 17 with a diameter marginally smaller than the diameter of the side wall 83. It follows that where the head of the screw is to enter the guideway 82, the screw access opening must have a circumferential extent of at least 180°. Where the shank of the screw is to enter the guideway, the screw access opening may have a lesser circumferential extent.

In the forward section, the side wall 83 of the guide tube 75 engages the radially outermost periphery of the head 17 of the screw 16, to axially locate the screw head 17 coaxially within the guideway 82 in axial alignment with the drive shaft 34. In this regard, the side wall 83 preferably extends about the screw sufficiently to coaxially locate the screw head and, thus, preferably extend about the screw head at least 120°, more preferably, at least 150° and, most preferably, about 180°.

An exit opening 87, shown towards the left-hand side of the guide tube 75 in FIGS. 4 and 5, is provided of a size to permit the spent plastic strip 13 from which the screws 16 have been driven to exit from the guideway 82. Forwardly of the exit opening 87, the side wall 83 of the guide tube 75 is shown as extending about 180° about the longitudinal axis 52 so as to continue to provide a side wall 83 which can assist and positively coaxially guiding the head 17 of a screw 16 being driven.

Figure 2:
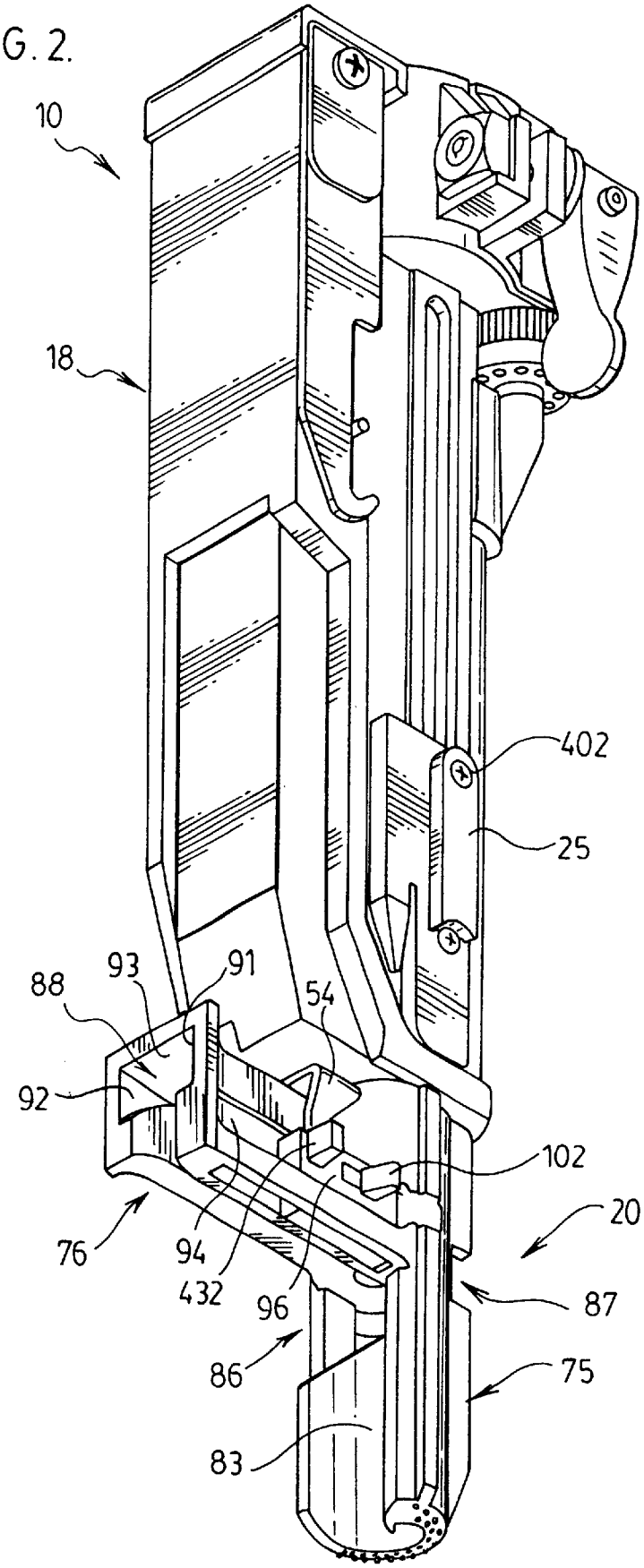
FIG. 2 is a rear view of the components of the driver attachment in FIG. 1.

The screw feed channel element 76 is best seen in FIGS. 2, 3 and 4 as providing a channelway 88 which extends radially relative the longitudinal axis 52 to intersect with the guideway 82 in the guide tube 75. In this regard, the channelway 88 opens to the guideway 82 as the screw access opening 86. The channelway 88 provides a channel of a cross-section similar to that of the screw access opening 86 from the screw access opening 86 to a remote entranceway opening 90. The channelway 88 is defined between two side walls 91 and 92 joined by a top wall 93. The major side wall 91 is shown as extending from the heads 17 of the screws 16 forwardly to at least partially behind the plastic retaining strip 13. The lesser side wall 92 is shown as extending from the heads 17 of the screws 16 forwardly to above the plastic strip 13. Stopping the lesser side wall from extending down over the strip 13 assists in reducing friction between the strip 13 and the lesser side wall. The side walls 91 and 92 define the channelway 88 with a cross-section conforming closely to that of the screwstrip 14 and its strip 13 and screws 16 with an enlarged width where the heads of the screws are located and an enlarged width where the retaining strip 13 is provided about the screws. The side walls 91 and 92 also have an enlarged funnelling section at the entranceway opening 90 which tapers inwardly to assist in guiding the screwstrip to enter the channelway.

Pawl Mechanism

As best seen in FIG. 2, the major side wall 91 is provided on its exterior back surface with a raceway 94 extending parallel the channelway 88 and in which a shuttle 96 is captured to be slidable towards and away from the guide tube 75 between an advanced position near the guide tube and a withdrawn position remote from the guide tube. The shuttle 96 has a rear surface in which there is provided a rearwardly directed opening 98 adapted to receive the front end 56 of the forward arm 54 of lever 48 so as to couple the shuttle 96 to the lever 48 for movement therewith.

Figure 9:
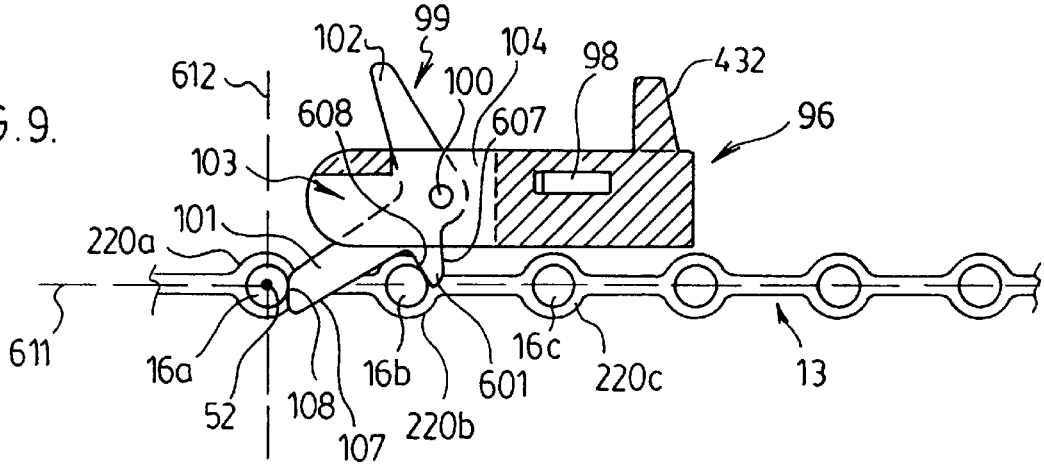
FIG. 9 is a schematic cross-sectional view along line 9–9' in FIG. 4 showing merely the screwstrip and the shuttle in a fully advanced position.
Figure 11:
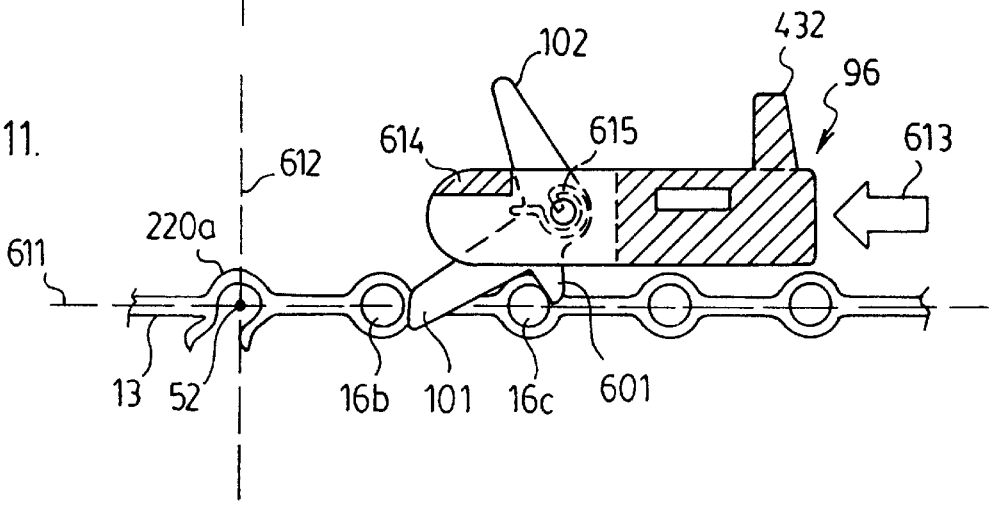

Shuttle 96 carries a pawl 99 to engage the screwstrip 14 and with movement of the shuttle 96 to successively advance the strip one screw at a time. As seen in FIG. 9, the shuttle 96 has a fixed post 100 on which the pawl 99 is journalled about an axis parallel the longitudinal axis 52 about which the driver shaft rotates. The pawl 99 has a first pusher arm 101 at its forward end to engage a first lead screw 16*a* and a second pusher arm 601 to engage a second screw 16*b*. The pusher arms extend out from slot 103 in the shuttle 96 and through a slot 105 in the major side wall 91 of the feed channel element 76 to engage and advance the screwstrip. The pawl 99 has a manual release arm 102 which extends out away from the screwstrip through the opening 104 from slot 103 of the shuttle 99. A torsional spring 615, shown only in FIG. 11, is disposed about post 100 between pawl 99 and shuttle 96 and urges the first pusher arm 101 counterclockwise as seen in FIG. 9. The torsional spring biases the pusher arms into the screwstrip 14. The engagement of release arm 102 on the left-hand end of opening 104 limits the pivoting of the pawl 99 counterclockwise to the blocking position shown in FIG. 9.

The first pusher arm 101 has a cam face 107 and the second pusher arm 601 has a cam face 607. On the shuttle moving away from the guide tube 75 towards the withdrawn position, i.e., to the right from the position in FIG. 9, the cam faces 107 and/or 607 will engage the screws 16*b* and 16*c*, respectively, and/or the strip 13 and permit the pawl 99 to pivot about post 100 against the bias of the torsional spring to a passage position so that the shuttle 96 may move to the right relative the screwstrip 14.

The first pusher arm 101 has an engagement face 108 to engage the screws 16 and the second pusher arm 601 has an engagement face 608 to also engage the screws 16. On the shuttle moving towards the guide tube 75, that is, towards the advanced position and towards the left as seen in FIG. 11, the engagement faces 108 and 608 will engage the screw 16*b* and 16*c*, respectively, and/or strip 13 and advance the screwstrip to the right as seen in FIG. 11 so as to position a screw 16*b* into the guideway 82 in a position to be driven and to hold the screwstrip 14 against movement towards the left. Preferably, as shown in FIG. 4, the engagement face 108 of the first pusher arm 101 engages the screw 16 between its head 17 and the strip 13 as this has been found advantageous, particularly to avoid misfeeding with a nose portion 24 as shown with engagement of the screw heads in the channelway 88 and engagement of the spent strip 13 with the support surface 125.

Figure 10:
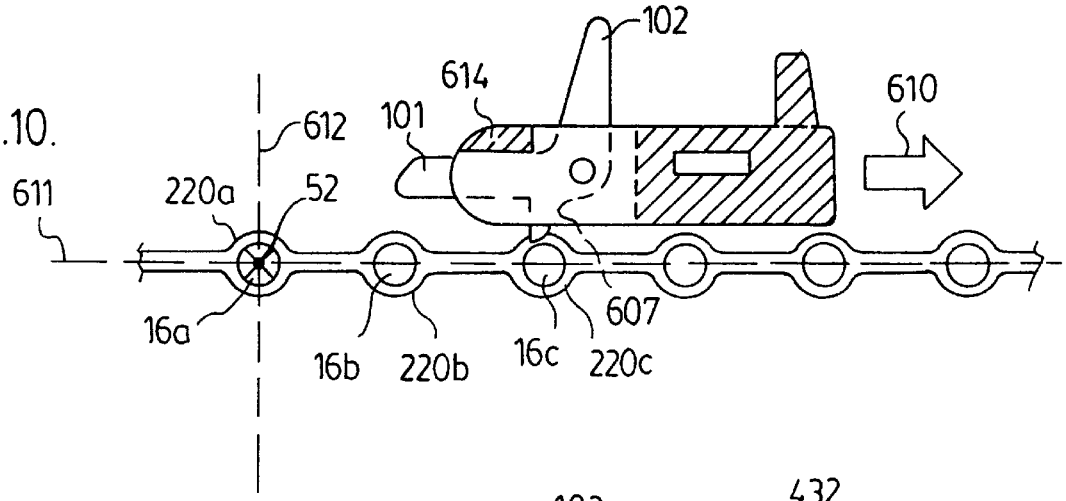
FIGS. 10 and 11 are views the same as FIG. 9 but with the shuttle being withdrawn in an intermediate position in FIG. 10 and in a filly withdrawn position in FIG. 11.

The operation of the shuttle 96 and pawl 99 in normal operation to advance the screwstrip are illustrated in FIGS. 9, 10 and 11, representing successive steps in a cycle of reciprocating the shuttle 96 back and forth in the raceway 94.

As seen in FIG. 11, a dashed line 611 represents a plane of advance in which the axis of each of the screws 16 lie and along which the screwstrip 14 is advanced towards the left such that screws may successively be brought into alignment with the driver shaft whose axis 52 is to occur at the intersection of advance plane 611 with a dashed axis line 612. To the left of axis line 612, spent strip 13 is shown with a broken sleeve 220*a* from which a screw has been driven.

As seen in FIG. 9, the engagement face 108 of the first pusher arm 101 is engaged behind the first screw 16*a* and the engagement face 608 of the second pusher arm 601 is engaged behind the second screw 16*b*, whereby the screwstrip 14 is held in a position blocked against movement of the strip to the right relative the shuttle 96.

In the position in FIG. 9, the first screw 16*a* in sleeve 220*a* is axially in line with the axis 52 of the driver shaft ready for driving.

From the position of FIG. 9, in use of the tool, the lead screw 16*a* is driven from sleeve 220*a* and the shuttle 96 is withdrawn to the right passing through the position of FIG. 10 to assume the position of FIG. 11. Thus, as seen in FIG. 10, arrow 610 represents the withdrawal of the shuttle 96 relative the driver shaft and screwstrip 14.

From the position of FIG. 9 on movement of the shuttle 96 towards the right relative the screwstrip 14, it is to be appreciated that the camming surface 107 of the first arm 101 engages screw 16*b* and such engagement causes the pawl 99 to pivot about axis 100 against the bias of the spring. With further relative movement of the shuttle to the right, the camming surface 107 will continue to pivot the pawl 99 until the camming surface 607 comes to engage screw 16*c* and further pivot the pawl 99 so that the second arm 601 may pass to the left of the screw 16*c*. FIG. 10 illustrates the shuttle 96 as moving to the right as indicated by arrow 610 and with cam face 607 of the second pusher arm 601 engaging screw 16*c* in sleeve 220*c*.

The engagement of the cam faces with the screws pivots the pawl 99 against the bias of the torsional spring such that the pawl 99 may rotate clockwise. On the first pusher arm 101 moving to the right past screw 16*b* and the second pusher arm 601 moving to the right past screw 16*c*, the torsional spring urges the pawl 99 to rotate about post 100 so that the engagement faces 108 and 608 are positioned ready to engage the screws 16*b* and 16*c* and advance them to the left, indicated by arrow 613, as seen in FIG. 11.

FIG. 11 shows the shuttle 96 withdrawn rearwardly sufficiently to a position that the engagement faces 108 and 608 are to the right, rearward of the screws 16*b* and 16*c* in sleeves 220*b* and 220*c* and with the screw 16*a*, not seen, as it has been driven from the fractured sleeve 220*a*. From the position of FIG. 11, the shuttle 96 is moved to the left relative the axis 52 thereby advancing the screwstrip 14, moving it to the left and placing the screw 16*b* in the sleeve 220*b* into axial alignment with the driver shaft axis 52. In advance of the screwstrip 14, both the first and second pusher arms 101 and 601 engage their respective screws and urge the screwstrip 14 to advance.

One advantage of the pawl 96 of the present invention having two pusher arms 101 and 601 which engage two different screws arises in situations where, in use of a tool, the shuttle 96 may not move from the position of FIG. 9 to the right sufficiently to have the first pusher arm 101 engage to the right of the screw 16*b* in sleeve 220*b*. For example, if a shuttle 96 having only arm 101 and not arm 601 move to the right only as far as shown in FIG. 10, then, after the screw 16*a* in sleeve 220*a* is driven from sleeve 220*a*, there is no screw to the left of the only pusher arm 101 which the pusher arm 101 may engage to stop movement of the screwstrip 14 to the right. In previously known devices as taught in U.S. Pat. No. 5,934,162 with merely a single pusher arm 101, where the single pusher arm does not engage the next screw, the screwstrip 14 can merely move rearwardly to the right and fall out of the channelway 88 and, thus, out of the tool. With the device of the present invention in the position of FIG. 10, the second pusher arm 601 is to the right of screw 16*b* in sleeve 220*b* and will prevent the screwstrip 14 from removal or falling out by movement of the screwstrip to the right.

With the pawl 99 in the position shown in FIGS. 9 and 11, the pawl 99 prevents movement and withdrawal of the screwstrip 14 to the right relative the shuttle 96. To permit manual withdrawal of the screwstrip 14, the manual release arm 102 may be pivoted, as by a user's finger, clockwise against the bias of spring so that the first pusher arm 101 and second pusher arm 601 are moved away from and clear of the screwstrip 14. With the release arm 102 manually rotated clockwise from the position shown in FIG. 10 until rotation of the first arm 101 is stopped by abutment 614 in the shuttle, the screwstrip 14 may be manually withdrawn in a direction toward the right as may be useful, for example, to clear jams or change screwstrips.

In manually pivoting the pawl 99 as with a user's thumb from the position of FIG. 9 to the position of FIG. 10, the engagement faces 108 and 608 are moved substantially transversely relative the length of the screwstrip 14 to become disengaged from the screws 16*a* and 16*b*. To facilitate this, the axis about which the pawl 99 pivots, i.e. the axis of post 100, is located to the right relative the longitudinal of the screwstrip 14 from the rearwardmost screw 16*b* to be engaged by the second pusher arm 601. As well, the engagement faces 108 and 608 are disposed substantially normal to the plane of advance 611 of the screwstrip 14 when the pawl release arm 102 is rotated as far as possible counterclockwise.

Figure 12:
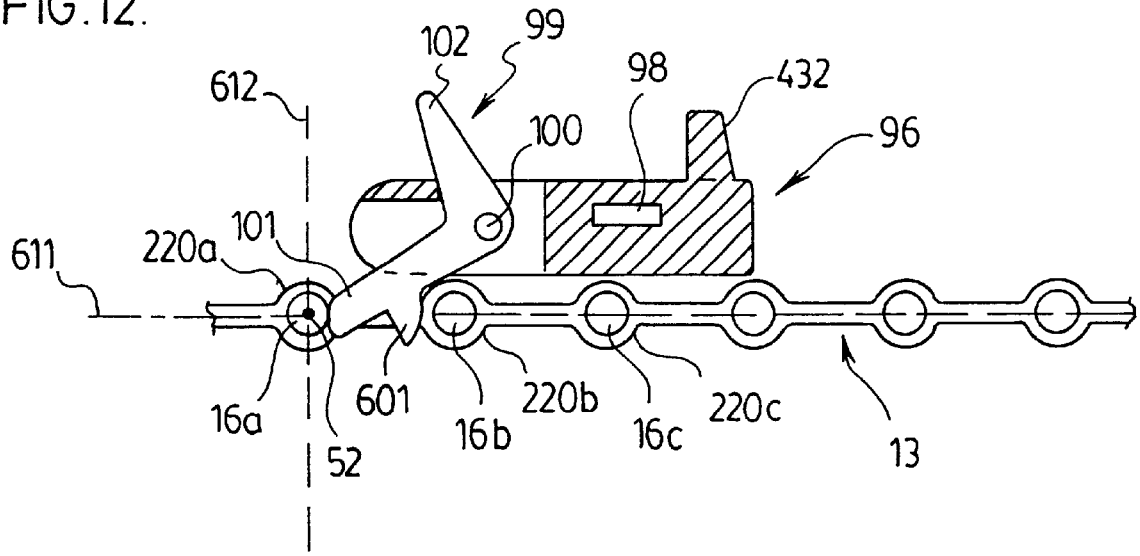
FIG. 12 is a view similar to FIG. 9 but with a modified pawl.

In FIGS. 9 to 11, the pawl 99 is configured such that the engagement face 108 of the first pusher arm 101 and the engagement face 608 of the second pusher arm 601 are spaced a distance equal to the spacing between screws such that each face engages a different screw. FIG. 12 is identical to FIG. 9 other than in the location of the second pusher arm 601 on the pawl 99. FIG. 12 shows an alternate arrangement in which the engagement faces 108 and 608 are spaced less than the distance between screws. The face 608 in FIG. 12 serves a purpose as when the shuttle 96 is not withdrawn rearwardly to a position with the engagement face 108 to the right of the screw 16*b* of preventing undesired withdrawal of the screwstrip 14. Provided the engagement surface 608 is to the right of screw 16*b,* it will, if the screwstrip 14 is attempted to be moved to the right, pivot under the bias of the spring to engage screw 16*b* and prevent rearward removal of the screwstrip 14.

The pawl 99 is shown in FIGS. 9 to 11 as having a length to engage two adjacent screws. It is to be appreciated that the pawl could be modified to have an increased length to span more than two screws. As well, while the pawl 99 has two engagement faces, it could have three or more engagement faces to engage, for example, three or more of the screws.

The figures show pawl 99 carried on a slidable shuttle. However, it is within the scope of the present invention that the pawl be mounted, for example, for pivoting directly on the end of a lever arm as, for example, on the front end 56 of the forward arm 54 of the lever 48 without any shuttle being provided.

An advantage of the present invention is that while two engagement faces 108 and 608 provide two members to stop removal of the strip by engaging the screws that only one release arm 102 needs to be activated by a user to release both engagement faces 108 and 608. This provides for a simplified, preferred structure with only a single pivot axis required. A single release arm 102 is provided for two engagement faces. Such a structure is preferred over two pawls each pivoted about their own axis and having two separate release arms or a coupling mechanism coupling the pawls together for release of both by moving one of the pawls.

The release arm 102 permits manual withdrawal of the screwstrip 14. A user may with his finger or thumb manually pivot the release arm 102 against the bias of spring so that both the first pusher arm 101 and its engagement face 108 and the second pusher arm 601 and its engagement face 608 are moved away from and clear of the screwstrip 14 whereby the screwstrip may manually be withdrawn as may be useful to clear jams or change screwstrips.

A fixed post 432 is provided on shuttle 96 opposed to the manual release arm 102 to permit pivoting of the release arm 102 by drawing the release arm 102 towards the fixed post 432 as by pinching them between a user's thumb and index finger.

The lever 48 couples to the shuttle 96 with the forward arm 54 of lever 48 received in the opening 98 of the shuttle 96. Sliding of the slide body 20 and the housing 18 in a cycle from an extended position to a retracted position and then back to an extended position results in reciprocal pivoting of the lever 48 about axle 50 which slides the shuttle 96 between the advanced and withdrawn position in its raceway 94 and, hence, results in the pawl 99 first retracting from engagement with a first screw to be driven to behind the next screw 16 and then advancing this next screw into a position to be driven.

The nose portion 24 carries the guide tube 75 with its screw locating guideway 82, the screw feed channel element 76 with its channelway 88, and screw feed advance mechanism with the reciprocating shuttle 96 and pawl 99 to advance the screwstrip 14 via the channelway 88 into the guideway 82. Each of the guideway 82, channelway 88 and shuttle 96 are preferably customized for screwstrips and screws or other fasteners of a corresponding size. In this context, size includes shape, head diameter, shaft diameter, retaining strip configuration, length, spacing of screws along the retaining strip and the presence or absence of washes amongst other things. Different nose portions 24 are to be configured for different screwstrips and screws. Different modified slide bodies 20 can be exchanged so as to permit the driver attachment to be readily adapted to drive different screwstrips and screws.

Many changes can be made to the physical arrangement of the nose portion 24 to accommodate different screws and fasteners. For example, the cross-sectional shape of the channelway 88 can be changed as can the diameter of the guideway 82. The length of the side walls 91 and 92 about the channelway 88 can be varied to accommodate different size screws which may require greater or lesser engagement.

The construction of the housing 18 and slide body 20 provide for a compact driver attachment.

The housing 18 includes side wall 301. The slide body 20 as best seen in FIG. 3 has a part cylindrical portion of a uniform radius sized to be marginally smaller than a part cylindrical inner surface of the side wall 301 of the housing 18. The side wall 301 extends circumferentially about the part cylindrical portion of the slide body 20 to retain the slide body 20 therein.

The housing has a flange portion 302 which extends radially from one side of the part cylindrical portion and is adapted to house the radially extending flange 46 of the rear portion 22 and the screw feed activation mechanism comprising the lever 48 and cam follower 62. The flange portion 302 is open at its front end and side to permit the screw feed channel element 76 to slide into and out of the housing 18. Concentrically located about the drive shaft 34 is the spring 38, the part cylindrical portions of the slide body 20, and the interior part cylindrical portions of the housing 18.

Hooked Nosepiece

Figure 13:
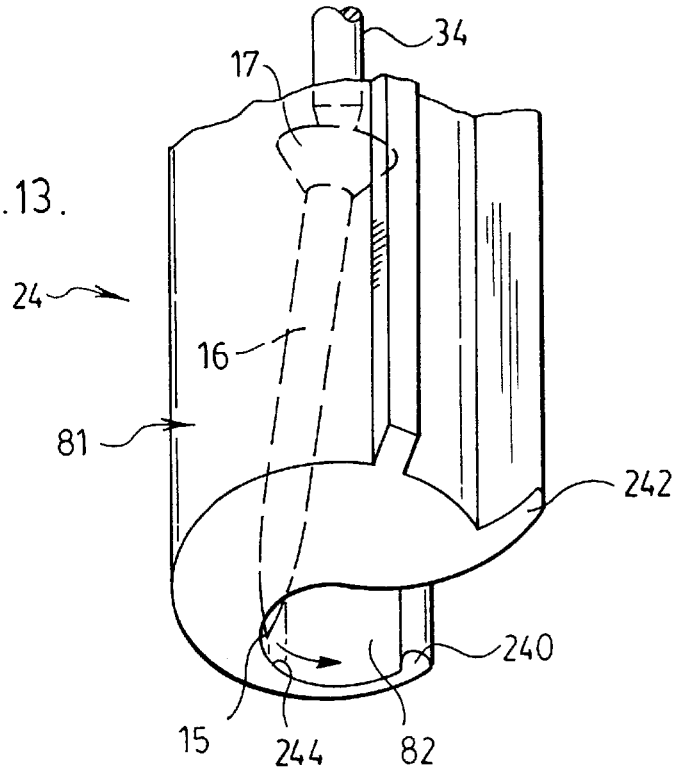
FIG. 13 is a pictorial view of the nosepiece shown in FIG. 1 schematically showing a screw received therein.
Figure 14:
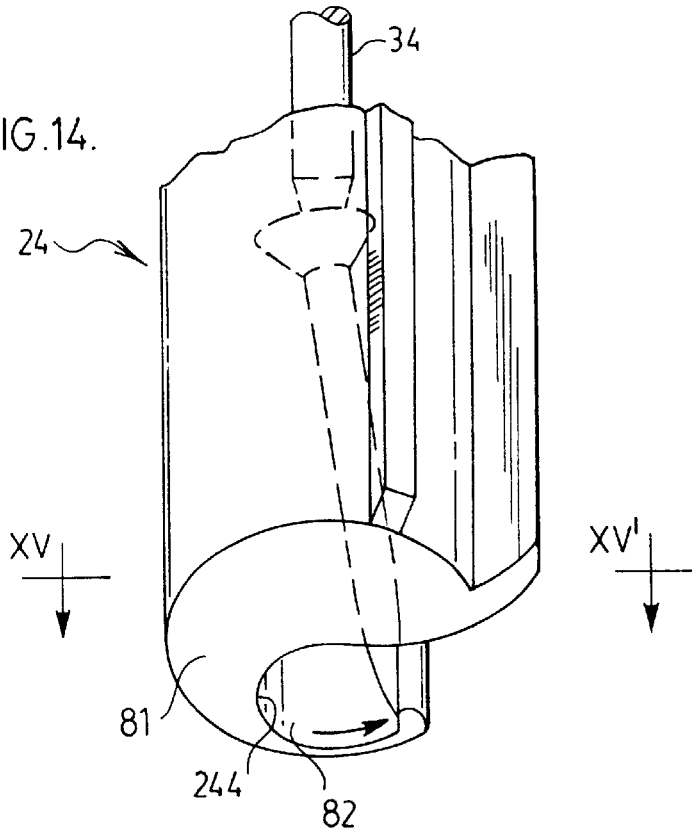
FIG. 14 is a pictorial view of the nosepiece as in FIG. 13 with a screw in a different position.
Figure 15:
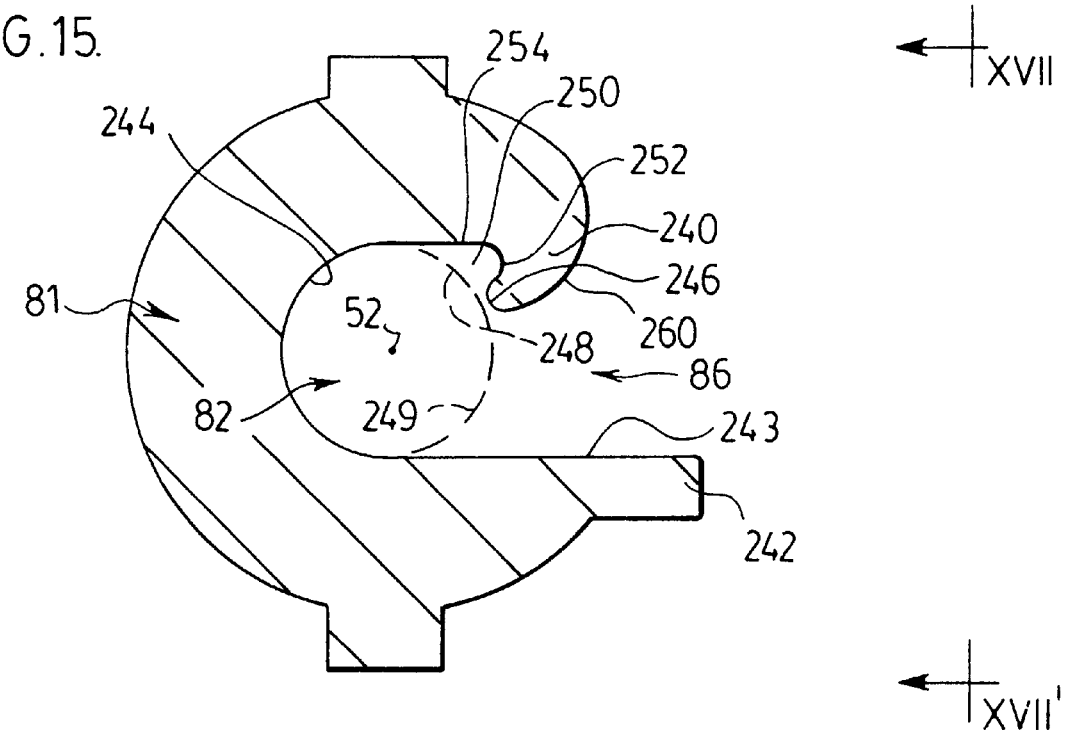
FIG. 15 is a cross-sectional view of the nosepiece of FIG. 14 along section line XV–XV'.

Reference is made to FIGS. 13 to 16 which show the nose portion 24 of the slide body 20 shown in FIGS. 1 to 8. The nose portion 24 has guideway 82 therethrough defined within wall 81 which extends circumferentially from a first end 240 of the wall to a second end 242 of the wall. As seen in FIG. 15, the wall 81 has a generally C-shape in cross-section normal the axis 52 of the guideway 82. The guideway 82 is shown in FIG. 15 as represented by the area within a circle about axis 52. The outer periphery of the guideway 82 is a cylindrical surface delineated in part by part-cylindrical portions 244 and 246 of the inwardly directed inner surface 83 of the wall 81 with the remainder of the outer periphery of the guideway shown as delineated by two segments 248 and 249 of a dashed circle line. The access opening 86 is seen in FIG. 15 as providing, in effect, a slotway which is radially outwardly of the guideway 82 and effectively extends radially outwardly from the guideway 82 as an axially extending slotway between the ends 240 and 242 of the wall 81 through the wall 81 to permit a screw to enter the guideway 82 radially with the screw maintained substantially parallel the axis 52 of the guideway 82. The first end 240 of the wall 81 forms a hook-shaped member having a radially inwardly directed bight 250 which extends axially along the cylindrical guideway 82 and opens radially inwardly into the guideway 82. The bight 250 forms a groove-like, channelway or catch trough adapted to assist in retaining a tip of a screw which becomes received therein in the bight 250 against removal. The hook member about the bight 250 has an inner bight surface shown as comprising surface 252 on a side closest to the access opening 86 and surface 254 on the side remote from the access opening 86.

As seen in FIG. 15, the catch trough or bight 250 is delineated between the bight surfaces 252 and 254 and circle line segment 248. The bight surface 254 on the side of the bight remote from the access opening 86 is seen to merge tangentially into the part-cylindrical portion 244 of the inner surfaces about the guideway 82. The inner surface 252 on the side of the bight closest the access opening 86 is directed circumferentially away from the access opening 86.

Reference is made to FIGS. 13 and 14 which schematically illustrate a "renegade" screw 16 which has its screw head 17 coaxially within the guideway 82 as with a bit 122 of the driver shaft 34 engaging the head. The axis of the screw is out of axial alignment with the axis of the guideway 82 such that the shank and/or tip 15 of the screw is engaged with the inner surfaces of the wall 81. FIG. 13 shows the tip 15 of the screw 16 engaging the part-cylindrical portion 244 of the inner surface of the wall 81. In rotation and driving of the screw 16 by the driver shaft 34, there is a probability and/or tendency for the tip 15 of the screw to move along the inner surface of the wall circumferentially clockwise as seen in FIG. 13 from the position in FIG. 13 to the position in FIG. 14. When the tip 15 reaches the position in FIG. 14, the shank and/or tip of the screw 16 enters the bight 250 as guided therein by engagement with firstly, the portion 224 of the inner surface and then, subsequently, with inner bight surface 254 and inner bight surface 252. While engagement with the portion 224 and inner bight surface 254 directs the tip to continue to slide circumferentially toward the access opening 86, engagement with inner bight surface 252 tends to catch the tip in the bight 250 and resist further circumferential movement towards the access opening 86. Preventing such a renegade screw 16 from having its tip extend out through the access opening 86 is advantageous to prevent malfunction of the apparatus and/or jamming.

To assist in retaining the tip 15 of a screw 16 in the bight 250, at least against circumferential movement towards the access opening 86, the inner bight surface 252 is directed circumferentially away from the access opening 86. Once a tip 15 of a screw may be engaged within the bight 250, typically on driving the screw 16 forwardly by the driver shaft 34, the tip 15 will slide axially forwardly within the bight 250 until it leaves the forward end of nose portion 24 and become engaged within a workpiece for subsequent driving in an acceptable manner.

FIG. 15 shows the second end 242 of the wall 81 having a portion 243 of the inner surface of the wall which extends as a substantially tangential extension of the part-cylindrical portion 244.

FIG. 15 also shows the distal end of the hook-shaped member as forming the part-cylindrical portion 246 which assists in defining the periphery of the guideway 82. The part-cylindrical portion 246 may be no more than an axially extending surface of negligable circumferential extent, however, located the same distance from axis 52 as portion 244.

The part-cylindrical portions of the inner surface of the wall 81 effectively extend circumferentially about the guideway 82 other than over the sector represented by the segments 248 and 249 of the dashed circle line. Preferably, this segment 249 has a circumferential extent as small as practically possible to assist in retaining the head 17 of a screw within the guideway 82. It is preferred that the part-cylindrical portions of the inner surface of the wall extend about the axis 52 greater than 180° so as to retain a head of a screw in the guideway against lateral removal. Conversely, the segment 249 preferably has a circumferential extent of less than 180° and, more preferably, less than about 120° at least forward of where the head of the screw must pass radially into the guideway 82.

Figure 16:
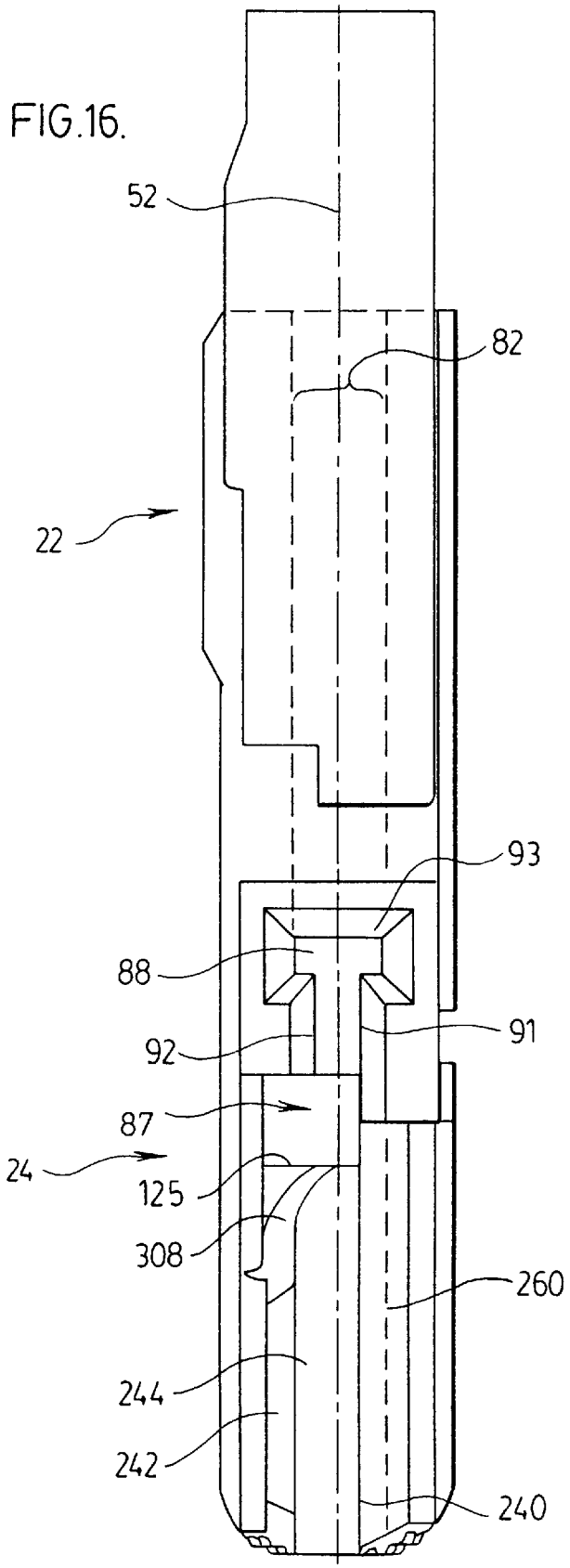
FIG. 16 is an elevational rear view of the slide body 20 of FIG. 3.

FIG. 16 shows an end elevation view of the slide body 18 of FIG. 4, however, with the lever 48 and shuttle mechanism removed. FIG. 16 thus represents a view of the nose portion 24 and rear portion 22 as viewed along line XVII–XVII' in FIG. 5. As seen in FIG. 16, the channelway 88 with its side walls 91 and 92 and top wall 93 extends radially into the guideway 82 maintaining throughout the extent of the channelway 88 a width between the side walls 91 and 92 sufficiently large to receive the head of the screw and permit the head of the screw to pass radially into the guideway 82. Forwardly from where the channelway 88 is of enlarged width to receive the head of the screw, the channelway is of reduced width, being a width which is merely sufficient to permit the shank of the screw to pass therethrough. As best shown in FIG. 15, radially outwardly directed surface 260 of the hook-shaped first end 240 angles inwardly into the guideway 82 so as to assist in guiding as a cam surface the shank of a screw towards the wall 242 and, hence, into the guideway 82. While not necessary, it is preferred as shown in FIG. 16 that the hook-shaped member and its bight 250 extend the entire length from where the channelway 88 opens to pass the head of a screw forwardly to the forward end of the nose portion.

The hook-shaped member preferably serves at least two functions, firstly, in assisting and retaining a head of a screw in the guideway and, secondly, in catching the tip of any renegade screw. It follows, therefore, that the bight 250 need only be provided in forward portions of the guideway 82 where the tip of the screw may be located.

The hook-shaped member has been shown as having a bight 250 of constant cross-section along the length of the guideway 82. It is to be appreciated, however, that the bight 250 could have a varying cross-section, profile or configuration along its axial length. The bight 250 preferably extends axially along the guideway 82 parallel the axis 52, however, the bight 250 could extend at an angle to the axis 52 as, for example, as a part helix.

The nose portion 24, in effect, comprises an open-sided tubular member having wall 81 circumferentially about a central passageway extending therethrough and open at both ends. The central passageway includes the cylindrical guideway 82 and the screw catch groove or bight 250. The catch groove 250 extends axially along the guideway 82 cut into the wall 81 radially outwardly from the guideway 82. The catch groove 250 opens radially inwardly into the guideway 82 to define the inner bight surface 252 which provide a catch surface of the wall 81 located circumferentially proximate the slotway-like access opening 86 and directed away from the access opening 86. The access opening 86 extends as a slotway extending axially along the guideway 82 and radially outwardly from the guideway 82 entirely through the wall 81.

In the preferred nose portions 24 shown, the screw access opening 86 is shown to extend forwardly to the forward end of the nose portion 24. It is to be appreciated that the screw access opening 86 need only have an axial length as long as any screw to pass therethrough and the wall 81 may extend 360° about the guideway 82 forward of the access opening 86 such as taught in U.S. Pat. No. 5,699,704, issued Dec. 23, 1997, the disclosure of which is incorporated herein.

Figure 17:
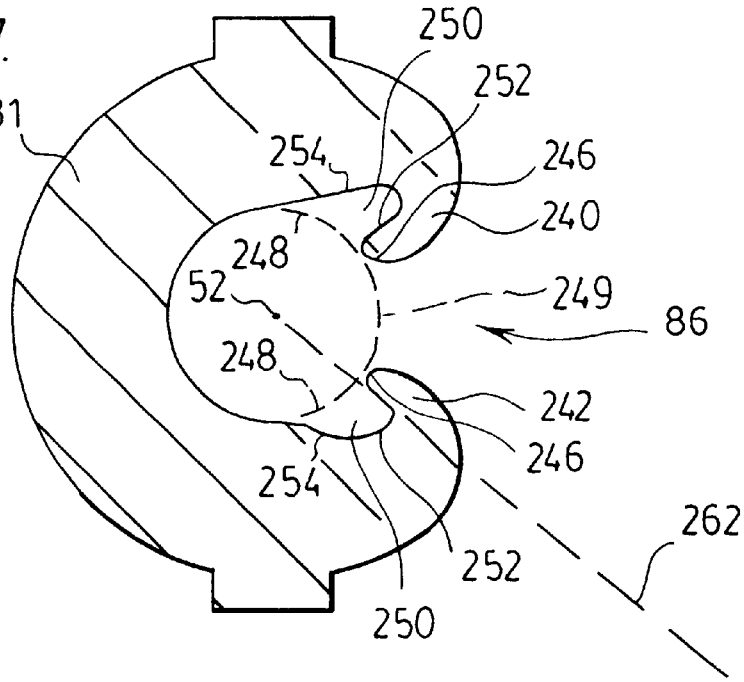
FIG. 17 is a cross-sectional view similar to that in FIG. 15, however, of another second embodiment of a nosepiece in accordance with the present invention.

Reference is now made to FIG. 17 which shows a cross-sectional view through another embodiment of a nosepiece similar to that in FIG. 15. The embodiment of FIG. 17 is shown, however, as having not only a hook-shaped member formed on the first end 240 of the wall 83 but also a second similar hook-shaped member formed as the second end 242 of the wall 83. The second hook-shaped member may function in a similar manner to the first hook-shaped member and both provide bights 250 each having surfaces 252 on the side closest to the access opening 86 which is disposed so as to be directed circumferentially away from the access opening 86 and assist in preventing a tip of a screw which becomes received in the bight 250 from moving from the bight 250 circumferentially towards the access opening 86.

FIG. 17 shows the surface 252 of the bight on the second end 242 as lying along a radial line generally indicated 264 extending from the axis 52 radially outwardly to a point where the surface 252 engages the outer cylindrical periphery of the guideway 82.

Figure 18:
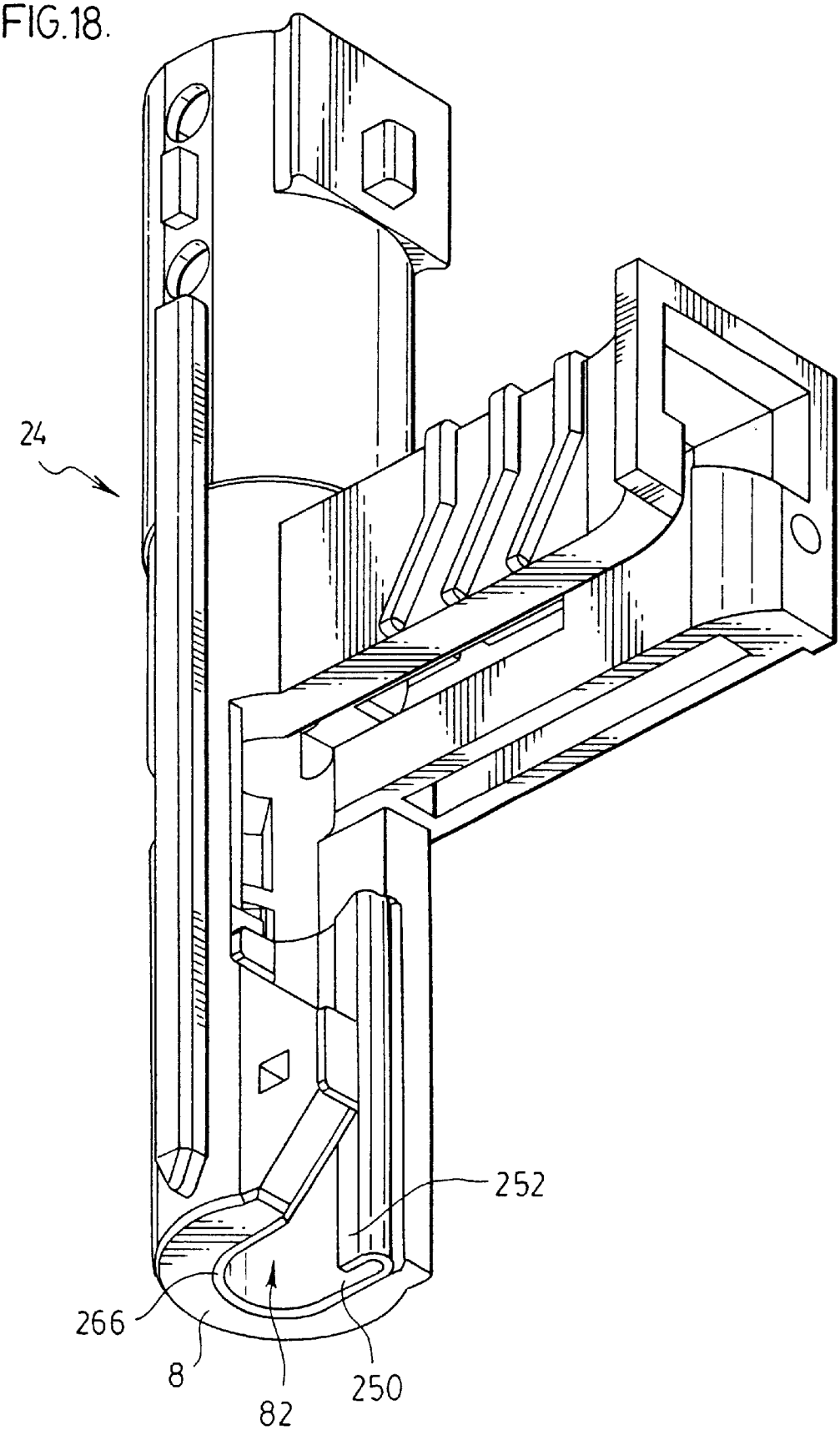
FIG. 18 is a pictorial view of a third embodiment of a nosepiece in accordance with the present invention.

Reference is made to FIG. 18 which shows a modified version of a nosepiece in accordance with the present invention which has features similar to the other nosepieces. The embodiment illustrated in FIG. 18 shows a nosepiece 24 preferably made out of synthetic material as by injection molding from plastic and to which a metallic insert 266 has been applied secured to the synthetic material. The insert 266 is preferably made of wear-resistant metal and is formed from a relatively thin sheet of metal. The insert 266 is secured inside the nosepiece so as to provide in a forward portion of the nosepiece the inner surfaces about the guideway 82 and to provide a hook-shaped member 252 at one side by the metal insert 266 being folded back on itself to form a distal end with the bight 250 therein.

Depth Stop Mechanism

The driver attachment is provided with an adjustable depth stop mechanism which can be used to adjust the fully retracted position, that is, the extent to which the slide body 20 may slide into the housing 18. The adjustable depth stop mechanism is best seen in FIGS. 3 and 5.

A depth setting cam member 114 is secured to the housing 18 for rotation about a pin 116, shown in FIG. 5, parallel the longitudinal axis 52. The cam member 114 has a cam surface 115 which varies in depth, parallel the longitudinal axis 52, circumferentially about the cam member 114. A portion of the cam surface 115 is always axially in line with the rear end 117 of the slide body 20. By rotation of the cam member 114, the extent to which the slide body 20 may slide rearwardly is adjusted.

The extent the slide body 20 may slide into the housing 18 is determined by the depth of the cam member 114 axially in line with the rear end 117 of the slide body 20. The cam member 114 is preferably provided with a ratchet-like arrangement to have the cam member 114 remain at any selected position biased against movement from the selected position and with circular indents or depressions in the cam surface 115 to assist in positive engagement by the rear end 1 17 of the slide body 20. A set screw 119, as seen in FIG. 3, is provided to lock the cam member 114 at a desired position and/or to increase resistance to rotation. The cam member 114 is accessible by a user yet is provided to be out the way and not interfere with use of the driver attachment. The depth stop mechanism controls the extent to which screws are driven into a workpiece and thus controls the extent of countersinking.

The slide body 20 may be customized for use in respect of different size screws by having the location of the stop surface 117 suitably provided axially on the slide body 20 as may be advantageous for use of different size screws.

The driver shaft 34 is shown in FIGS. 4 and 5 as carrying a split washer 120 engaged in an annular groove near its rear end 121 to assist in retaining the rear end of the driver shaft in the socket 27 of the housing 18. The driver shaft 34 is provided with a removable bit 122 at its forward end which bit can readily be removed for replacement by another bit as for different size screws. Such bits include sockets and the like and will preferably be of an outside diameter complementary to the inside diameter of the guideway 82.

The slide body 20 is shown in FIGS. 4 and 5 as having a radially inwardly extending annular flange 19 which provides the end of a rearwardly opening bore 79 within which the spring 38 is received. The annular flange 19 has an opening therethrough of a diameter preferably equal to the diameter of the guideway 88 and, in any event, at least slightly larger than the diameter of the driver shaft 34 so as to assist in journalling the driver shaft therein.

Insofar as the driver shaft 34 has a removable bit 122, when the driver attachment 12 is in the retracted position, the bit 122 may be readily accessible for removal and replacement.

Operation

Operation of the driver attachment is now explained with particular reference to FIGS. 4 and 5. As seen in FIG. 4, the screws 16 to be driven are collated to be held parallel and spaced from each other by the plastic retaining strip 13.

In operation, a screwstrip 14 containing a number of screws 16 collated in the plastic retaining strip 13 is inserted into the channelway 88 with the first screw to be driven received within the guideway 82. To drive the first screw into the workpiece 134, the power driver 11 is activated to rotate the driver shaft 34. The driver shaft 34 and its bit 122, while they are rotated, are reciprocally movable in the guideway 82 towards and away from the workpiece 134. In a driving stroke, manual pressure of the user pushes the housing 18 towards the workpiece 134. With initial manual pressure, the forward end of the nose portion engages the workpiece 134 to compress spring 38 so as to move slide body 20 relative the housing 18 into the housing 18 from an extended position shown in FIG. 4 to a retracted position. On release of this manual pressure, in a return stroke, the compressed spring 38 moves the slide body 20 back to the extended position thereby moving the housing 18 and the driver shaft 34 away from the workpiece.

In a driving stroke, as the driver shaft 34 is axially moved towards the workpiece, the bit 122 engages the screw head 17 to rotate the first screw to be driven. As is known, the plastic strip 13 is formed to release the screw 16 as the screw 16 advances forwardly rotated by the driver shaft 34. Preferably, the screw tip will engage in a workpiece before the head of the screw engages the strip such that engagement of the screw in the workpiece will assist in drawing the screw head through the strip to break the fragible straps, however, this is not necessary and a screw may merely, by pressure from the drive shaft, be released before the screw engages the workpiece. Preferably, on release of the screw 16, the plastic strip 13 deflects away from the screw 16 outwardly so as to not interfere with the screw 16 in its movement into the workplace. After the screw 16 is driven into the workpiece 134, the driver shaft 34 axially moves away from the workpiece under the force of the spring 38 and a successive screw 16 is moved via the screw feed advance mechanism from the channelway 88 through the access opening 86 into the guideway 82 and into the axial alignment in the guideway with the driver shaft 34.

The screw 16 to be driven is held in position in axial alignment with the driver shaft 34 with its screw head 17 abutting the side wall 83 in the guideway 82. As a screw 16 to be driven is moved into the cylindrical guideway 82, a leading portion of the strip 13 from which screws have previously been driven extends outwardly from the guideway 82 through the exit opening 87 permitting substantially unhindered advance of the screwstrip 14.

To assist in location of a screw to be driven within the guide tube 75, in the preferred embodiment the exit opening 87 is provided with a rearwardly facing locating surface 125 adapted to engage and support a forward surface 222 of the strip 13. Thus, on the bit 122 engaging the head of the screw and urging the screw forwardly, the screw may be axially located within the guide tube 75 by reason not only of the head of the screw engaging the side wall 83 of the guideway but also with the forward surface 222 of the strip 13 engaging the locating surface 125 of the exit opening 87. In this regard, it is advantageous that the forward surface 222 of the retaining strip 13 be accurately formed having regard to the relative location of the screws 16 and particularly the location of the their heads 17. The forward surface 222 of the strip 13 may be complementary formed to the locating surface 125.

In the embodiment of the nose portion 24 shown in FIGS. 1 to 6, on the bit 122 engaging the head 17 of the screw 16 and urging it forwardly in the guideway 82, the strip 13 is preferably held against movement forwardly firstly by the forward surface 222 of the strip engaging locating surface 125 and, secondly, by the under surfaces of the heads 17 of screws in the channelway 88 engaging on the rearwardly directed shoulders provided on each of the side walls 91 and 92 where the enlarged width cross-section of the channelway 88 accommodating the head of the screws reduces in width as seen in FIG. 2. Together with the location of the head 17 of a screw 16 coaxially in the guideway, the screw 16 to be driven is located axially aligned with the driver shaft without any moving parts other than the advance shuttle 96.

The driver attachment 12 disclosed may be provided for different applications. In a preferred application, the driver may be used for high volume heavy load demands as, for example, as in building houses to apply sub-flooring and drywall. For such a configuration, it is preferred that with the power driver 11 comprising a typical screw gun which inherently incorporates a friction clutch and thus to the extent that a screw is fully driven into a workpiece, the clutch will, on the forces required to drive the screw becoming excessive, slip such that the bit will not be forced to rotate an engagement with the screw head and thus increase the life of the bit.

With the preferred embodiments of this invention using but one pawl 99, a preferred configuration of the relative timing of pivoting of the lever 48 compared to the relative location of the slide body in the housing 18 is one in which the following aspects (a) and (b) are met, namely:

(a) firstly, the pawl 99 engages the screw to be driven to maintain the screw in axial alignment with the bit 122 until the bit 122 has engaged in the recess in the screw head for rotational coupling therewith; and (b) secondly, the pawl 99 sufficiently withdraws itself such that, before the screw being driven detaches itself from the strip 13, the pawl 99 is located engaged on the withdrawal side of the next screw to be advanced.

Aspect (b) is advantageous to ensure that the screwstrip may not be inadvertently withdrawn or dislodged before the pawl 99 becomes engaged behind the next screw to be advanced. While the screw being driven is attached to screwstrip, the screwstrip is held by the bit against removal by rearward movement. If, however, the screwstrip becomes detached from the screwstrip before the pawl 99 is behind the next screw to be driven, then at this time, the screwstrip can move in a direction opposite the direction of advance, for example, either to become removed from the feed channel element 76 or to be displaced an extent that the pawl cannot engage the next screw to be driven.

To have aspects (a) and (b) permits preferred advantageous operation with merely a single pawl 99 utilized to advance each screw, to hold it in place until the bit engages in the screw and then while the screw is held by the bit, to withdrawal to engage behind the next screw to be driven such that the pawl is engaged behind the next screw when the screw being driven becomes disengaged from the strip. For example, where aspect (b) is not satisfied, the difficulty can arise, for example, that in the movement of the pawl 99 towards the withdrawal position, the pawl 99 may engage the strip and itself move the strip in a direction opposite the advance direction. Having a relatively weak spring which urges the pusher arm 101 of the pawl into the screwstrip can reduce the likelihood that the pawl 99 may move the strip in a direction opposite the advance direction. Movement of the strip in a direction opposite the advance direction can be avoided by the screwstrip and screws being engaged in the screwdriver in frictional engagement to resist withdrawal. To some measure, such frictional engagement arises by reason of the spent screwstrip extending out of the exit opening 87 and the screw heads, shanks and/or strip frictionally engaging the screw feed channel element 76 and/or the guide tube 24. However, any such friction is contrary to a preferred configuration in which the frictional forces to be overcome by advance of the screwstrip are minimized. Therefore, it is a preferred system with least resistance to advance of the screwstrip and with a single pawl that it is most preferred that aspects (a) and (b) being incorporated in a tool.

It is also advantageous that in addition to aspects (a) and (b), that after aspect (a) and before aspect (b), an aspect (c)

is met whereby the pawl 99 moves toward the withdrawal position sufficiently that the pawl 99 is moved out of the path of the head of the screw and the driver shaft 34 and its bit 122 as they advance a screw. This aspect (c) is advantageous so as to avoid the pawl 99 interfering with the easy advance of the screw head, bit and mandrel.

Aspects (a), (b) and (c) can be achieved, for example, by the camming surfaces moving the lever 48 to hold the shuttle 96 and therefore the pawl 99 at a position either holding or urging the head of the screw into engagement within the guide tube in axial alignment with the bit until the bit engages in the recess in the head, rotatably coupling the bit and the screw and preferably driving the screw at least some distance. However, before the head of the screw moves forwardly sufficiently to engage the pawl 99, if the pawl 99 were not moved from the position of aspect (a), the camming surfaces causes the lever 48 to pivot moving the shuttle 96 towards the withdrawn position out of the way of the axial path of the head of the screw's bit and mandrel. The pawl 99 merely needs to be moved towards the withdrawn position such that it engages behind the next screw before the screw being driven disengages from the strip as by the head of the screw rupturing the strip. However, it is permissible if the pawl 99 moves relatively quickly compared to the advance of the screw being driven to the position behind the next screw.

As another fourth aspect to relative timing is the aspect that in the extension stroke a screw being advanced not interfere with withdrawal of the driver shaft and its bit. While embodiments can be configured so all interference is avoided, this is not necessary. Advantageously, when aspects (a), (b) and (c) are achieved as by minimizing the relative time that the pawl 99 engages the first screw in satisfying aspect (a), and prompt withdrawal to satisfy aspect (c), this can minimize the relative extent to which interference can arise between the next screw to be driven and the bit or mandrel on the extension stroke.

The driver attachment may be constructed from different materials of construction having regard to characteristics of wear and the intended use of the attachment. Preferably, a number of the parts may be molded from nylon or other suitably strong lightweight materials. Parts which are subjected to excessive wear as by engagement with the head of the screw may be formed from metal or alternatively metal inserts may be provided within an injection molded plastic or nylon parts. The optional provision of the nose portion 24 as a separate removable element has the advantage of permitting removable nose portions to be provided with surfaces which would bear the greatest loading and wear and which nose portions may be easily replaced when worn.

The screw feed advance mechanism carried on the nose portion has been illustrated merely as comprising a reciprocally slidable shuttle carrying a pawl. Various other screw feed advance mechanisms may be provided such as those which may use rotary motion to incrementally advance the screws. Similarly, the screws feed activation mechanism comprising the lever 48 and the cam follower have been shown as one preferred mechanism for activating the screw feed advance mechanism yet provide for simple uncoupling as between the shuttle 96 and the lever 48. Other screw feed activation means may be provided having different configurations of cam followers with or without levers or the like.

In the preferred embodiment, the screwstrip 14 is illustrated as having screws extending normal to the longitudinal extension of the strip 13 and, in this context, the channelway 88 is disposed normal to the longitudinal axis 52. It is to be appreciated that screws and other fasteners may be collated on a screwstrip in parallel spaced relation, however, at an angle to the longitudinal axis of the retaining strip in which case the channelway 88 would be suitably angled relative the longitudinal axis so as to locate and dispose each successive screw parallel to the longitudinal axis 52 of the driver shaft.

A preferred collated screwstrip 14 for use in accordance with the present invention is as illustrated in the drawings and particularly FIGS. 1 and 4 and are substantially in accordance with Canadian Patent 1,054,982. The screwstrip 14 comprises a retaining strip 13 and a plurality of screws 16. The retaining strip 13 comprises an elongate thin band formed of a plurality of identical sleeves interconnected by lands 106. A screw 16 is received within each sleeve. Each screw 16 has a head 17, a shank 208 carrying external threads and a tip 15. As shown, the external threads extend from below the head 17 to the tip 15.

Each screw is substantially symmetrical about a central longitudinal axis 212. The head 17 has in its top surface a recess for engagement by the screwdriver bit.

Each screw is received with its threaded shank 208 engaged within a sleeve. In forming the sleeves about the screw, as in the manner for example described in Canadian Patent 1,040,600, the exterior surfaces of the sleeves come to be formed with complementary threaded portions which engage the external thread of the screw 16. Each sleeve has a reduced portion between the lands 106 on one first side of the strip 13. This reduced strength portion is shown where the strip extends about each screw merely as a thin strap-like portion or strap.

The strip 13 holds the screws 16 in parallel spaced relation a uniform distance apart. The strip 13 has a forward surface 222 and a rear surface 223. The lands 106 extend both between adjacent screws 16, that is, horizontally as seen in FIG. 4, and axially of the screws 16, that is, in the direction of the longitudinal axes 212 of the screws. Thus, the lands comprise webs of plastic material provided over an area extending between sleeves holding the screws and between the forward surface 222 and the rear surface 223. A land 106 effectively is disposed about a plane which is parallel to a plane in which the axes 212 of all the screws lies. Thus, the lands 106 comprise a web which is disposed substantially vertically compared to the vertically oriented screws as shown in the figures. The lands 106 and the sleeves, in effect, are disposed as continuous, vertically disposed strip 13 along the rear of the screws 16, that is, as a strip 13 which is substantially disposed about a plane which is parallel to a plane containing the axes of all screws.

A preferred feature of the screwstrip 14 is that it may bend to assume a coil-like configuration due to flexibility of the lands 106, such that, for example, the screwstrip could be disposed with the heads of the screws disposed into a helical coil, that is, the plane in which all the axes 212 of the screws lie may assume a coiled, helical configuration to closely pack the screws for use. Having the lands 106 and sleeves as a vertically extending web lying in the plane parallel that in which the axes 212 permits such coiling.

The invention is not limited to use of the collated screwstrips illustrated. Many other forms of screwstrips may be used such as those illustrated in U.S. Pat. No. 3,910,324 to Nasiatka; U.S. Pat. No. 5,083,483 to Takaji; U.S. Pat. No. 4,019,631 to Lejdegard et al and U.S. Pat. No. 4,018,254 to DeCaro.

As seen in FIG. 3, the guide tube 75 has an outboard side which is partially cut away on its outboard side and has a continuous portion 382 of its outer wall which separates the screw access opening 86 from the exit opening 87 on the outboard side of the guide tube 75. As used herein, the outboard side is the side to which the strip 13 is deflected when a screw 16 is separated from the screwstrip 14.

To accommodate deflection of the strip 13 away from a screw 16 towards the outboard side, the passageway which extends from the screw access opening or entranceway 86 to the exit opening or exitway 87 is provided on its outboard side with a lateral strip receiving slotway 304 cut to extend to the outboard side from the cylindrical guideway 82. The slotway 304, as best seen in FIGS. 2 and 3, is bounded on the outboard side by side surface 306, at its forward end by ramped surface 308 and forward surface 125, and at its rear end by rear surface 312.

The access opening 86 forms an entranceway for the screwstrip 14 generally radially into the guideway 82 on one side. The exit opening 87 forms an exitway for portions of the strip 13 from which screws 16 have been driven, such portions being referred to as the spent strip 13.

The exit opening or exitway 87 is shown as adapted to encircle the spent strip 13 with the exitway 87 bordered by rearwardly directed forward surface 125, forwardly directed rear surface 312, inboard side surface 314 and outboard side surface 316.

As seen in FIG. 3, ramped surface 308 is an axially rearwardly directed surface which angles forwardly from the forward surface 125 towards the entranceway.

The ramped surface 308 extends forwardly from forward surface 125 with the ramped surface following the curvature of the side wall 83 as a ledge of constant width. The ramped surface 308 is useful to assist in driving the last screw from a strip as disclosed in U.S. Pat. No. 5,934,162 to Habermehl.

When the last screw 16 in a strip is located in the guideway, the fact that the exitway 86 encloses the spent strip 13 prevents the strip from rotating about the axis of the guideway to an orientation in which the screw 16 might be able to drop out of the guideway or the screw when driven is increasingly likely to jam. The spent strip 13 may extend from the exitway 87 at various angles limited only by the location of the side surfaces 314 and 316.

The configuration of FIG. 3 is advantageous to better ensure that the last screw 16 in any screwstrip 14 is driven and to generally assist in reducing the likelihood of any screw 16 being driven becoming jammed in the guideway with the strip 13.

Preferred strip segments for use with the drive attachment in accordance with this invention are, as shown in FIG. 1, segments of discrete length in which the axis of all strips lie in the same flat plane and in which the heads 17 of the screws are all located in a straight line.

Reference is made in FIGS. 1 and 3 to the slide stops 25 which are secured to the rear portion 22 of the slide body 20 by bolts 402 such that the slide stops 25 slide in longitudinal slots 40 on each side of housing 18 to key the slide body and housing together and to prevent the slide body being moved out of the housing past a fully extended position.

While the invention has been described with reference to preferred embodiments, many modifications and variations will now occur to persons skilled in the art. For a definition of the invention, reference is made to the appended claims.

We claim:

1. An apparatus for sequentially driving fasteners from a fastener strip comprising a plurality of fasteners secured in a row in a holding strip, the apparatus comprising:

a slide body having a lateral screwstrip receiving channelway and a guideway bore intersecting the channelway, the channelway configured to slidably receive the strip;

an elongate driver shaft having a shaft axis of rotation, said shaft including a fastener driving bit for engaging and driving fasteners in succession into a workpiece, said shaft being journalled and longitudinally slidably housed in said bore for reciprocal movement relative the slide body between an engaged position and a withdrawn position;

an advance mechanism mounted to said slide body for incrementally forwardly advancing the strip carrying the screws in the strip with the axis of each screw to pass in succession along a plane of advance within the channelway into the bore, said advance mechanism including a linkage member housed in said slide body and reciprocally movable between an advanced position and a retracted position as a function of cyclical reciprocal relative movement of the slide body and driver shaft, a pawl pivotally mounted on the linkage member for pivoting between a first blocking position and a second passage position, the pawl having a first arm with a first screw engaging surface and a second arm with a second screw engaging surface, in the first blocking position, both the first and second engagement surfaces are positioned in the plane of advance such that the first engagement surface blocks any screw in the screwstrip immediately forward of the first engagement surface from movement relative the first engagement surface rearwardly past the first engagement surface and the second engagement surface blocks any screw in the screwstrip immediately forward of the second engagement surface for movement relative the second engagement surface rearwardly past the second engagement surface, in the second passage position, both the first and second engagement surfaces are positioned out of the plane of advance such that they do not block screws in the screwstrip forward of the first or second engagement surfaces from movement relative the first and second engagement surfaces rearwardly past the first or second engagement surfaces.

2. An apparatus as claimed in claim 1 wherein the first engagement surface and second engagement surface are spaced a distance such that when the pawl is in the blocking position, when the first engagement surface engages a first screw in the screwstrip, the second engagement surface engages a second screw in the screwstrip.

3. An apparatus as claimed in claim 1 wherein the first engagement surface and second engagement surfaces are spaced a distance which is an integer of a distance between screws in the screwstrip.

4. An apparatus as claimed in claim 1 including a spring biasing the pawl from the second passage position towards the first blocking position.

5. An apparatus as claimed in claim 4 wherein the spring is disposed between the linkage member and the pawl and biases the pawl to pivot towards the first blocking position, the apparatus including a stop member to stop movement of the pawl under the bias of the spring at the first blocking position.

6. An apparatus as claimed in claim 5 wherein said pawl includes a cam surface to engage the screwstrip on movement of the linkage member from the advanced position to the retracted position and cam the pawl to pivot against the bias of the spring permitting movement of the screwstrip forwardly relative the pawl.

7. An apparatus as claimed in claim 6 wherein said first arm has an end carrying the first screw engaging surface to engage the strip to advance it and prevent rearward removal thereof, and the first arm has a side carrying a first camming surface to engage the strip on forward movement of the screwstrip relative the pawl and cam to pivot against the bias of the spring permitting movement of the screwstrip forwardly relative the pawl.

8. An apparatus as claimed in claim 7 wherein said second arm has an end carrying the second screw engaging surface to engage the strip to advance it and prevent rearward removal thereof and, the second arm has a side carrying a second camming surface to engage the strip on forward movement of the screwstrip relative the pawl and cam to pivot against the bias of the spring permitting movement of the screwstrip forwardly relative the pawl.

9. An apparatus as claimed in claim 1 including an activation mechanism manually activatable to move the pawl from the first blocking position to the second passage position.

10. An apparatus as claimed in claim 9 wherein the pawl having a manually engageable release arm for manual engagement to pivot the pawl to the second passage position, the release arm extending from the pawl away from the screwstrip and out of the slide body to present a portion of the release arm accessible for manual engagement.

11. An apparatus as claimed in claim 5 wherein said pawl is pivotally mounted to the linkage member for pivoting about a pivot axis substantially parallel the shaft axis, the channelway extending substantially normal the shaft axis.

12. An apparatus as claimed in claim 11 wherein the advance mechanism includes a shuttle reciprocally movable substantially parallel the channelway, the pawl pivotally mounted to the shuttle for pivoting about the pivot axis, the shuttle coupled to the linkage member for movement between the advanced and retracted positions.

13. An apparatus as claimed in claim 1 wherein the linkage member comprises a lever pivotally mounted to the slide body and having an end portion which is reciprocally movable between the advanced position and the retracted position, the pawl pivotally mounted to the end portion of the lever.

14. An apparatus as claimed in claim 1 including a shuttle slidably mounted to the slide body for reciprocal sliding therein, the linkage member comprising a lever pivotally mounted to the slide body and having an end portion which is reciprocally movable between the advanced position and the retracted position, the pawl pivotally mounted to the shuttle.

15. An apparatus as claimed in claim 13 further comprising:

a housing slidably coupled to the slide body for displacement parallel to the shaft axis, and rotatably supporting the driver shaft.

16. An apparatus as claimed in claim 14 wherein both the shuttle and the pawl are disposed on the same side of the plane of advance.

17. An apparatus as claimed in claim 1 wherein in the first blocking position, the pawl is positioned to engage the strip to forwardly advance the strip within the channelway on movement of the linkage member from the retracted position to the advanced position.

18. An apparatus for sequentially driving fasteners from a fastener strip comprising a plurality of fasteners secured in a row in a holding strip, the apparatus comprising:

a fastener driving mechanism defining a fastener driving position;

a fastener advance mechanism mounted to said fastener driving mechanism and including a fastener advancement member reciprocally moveable relative to said fastener driving mechanism between an advanced position and a retracted position;

a pawl pivotally mounted to said fastener advancement member and having a first arm with a first fastener engaging surface and a second arm with a second fastener engaging surface, said pawl being pivotable between a first blocking position and a second passage position;

said first arm being in engagement with a first fastener and said second arm being in engagement with a second fastener when said pawl is in said first blocking position.

19. The apparatus of claim 18 wherein said first and second arms are in advancing engagement with their respective first and second fasteners to advance said first and second fasteners toward said fastener driving position when said pawl is in said first blocking position.

20. The apparatus of claim 18 wherein said first and second arms are in engagement with adjacent first and second fasteners.

* * * * *